US008019257B2

(12) United States Patent
Ishida et al.

(10) Patent No.: US 8,019,257 B2
(45) Date of Patent: Sep. 13, 2011

(54) DEVELOPER-CONTROLLING MEMBER, MANUFACTURING METHOD THEREOF, DEVELOPING MACHINE USING THE DEVELOPER-CONTROLLING MEMBER, IMAGE FORMING APPARATUS OR PRINTER USING THE DEVELOPING MACHINE, AND JOINTED PLATE

(75) Inventors: Kazuo Ishida, Atsugi (JP); Atsushi Ohta, Yamato (JP); Yuuya Nakatani, Atsugi (JP); Hiroshi Itoh, Sagamihara (JP); Chiaki Inomata, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 741 days.

(21) Appl. No.: 11/576,123

(22) PCT Filed: Aug. 1, 2005

(86) PCT No.: PCT/JP2005/014464

§ 371 (c)(1),
(2), (4) Date: Nov. 13, 2007

(87) PCT Pub. No.: WO2006/038375

PCT Pub. Date: Apr. 13, 2006

(65) Prior Publication Data

US 2008/0069597 A1 Mar. 20, 2008

(30) Foreign Application Priority Data

Sep. 30, 2004 (JP) ..... 2004-286288
Dec. 27, 2004 (JP) ..... 2004-376741

(51) Int. Cl.
*G03G 15/08* (2006.01)

(52) U.S. Cl. ..... 399/274; 399/284

(58) Field of Classification Search ..... 399/265, 399/273, 274, 275, 283, 284; 29/428, 432, 29/432.1, 432.2, 505; 156/92
See application file for complete search history.

(56) References Cited

U.S. PATENT DOCUMENTS 5,470,635 A * 11/1995 Shirai et al. ..... 428/131
6,868,243 B2 * 3/2005 Watanabe et al. ..... 399/113
2009/0074473 A1 * 3/2009 Takahashi et al. ..... 399/275

FOREIGN PATENT DOCUMENTS

JP 2-160123 6/1990
JP 3-68928 7/1991

(Continued)

OTHER PUBLICATIONS

U.S. Appl. No. 12/210,715, filed Sep. 15, 2008, Takahashi et al.

*Primary Examiner* — Robert Beatty
(74) *Attorney, Agent, or Firm* — Oblon, Spivak, McClelland, Maier & Neustadt, L.L.P.

(57) ABSTRACT

A developer-controlling member includes a first plate (36) and a second plate (35) attached to the first plate (36), the first and second plates (36, 35) being formed to extend in a longitudinal direction of a developing roller (30) including a magnet roller; a half blanking fitting projection (38) is formed on one of the first and second plates (36, 35), a fitting hole (49) fitting to the fitting projection (38) is formed in the other of the first and second plates (36, 35), and the first and second plates are fastened by caulking the fitting projection.

16 Claims, 23 Drawing Sheets

FOREIGN PATENT DOCUMENTS

| | | | |
|---|---|---|---|
| JP | 5 337572 | | 12/1993 |
| JP | 6-23615 | | 3/1994 |
| JP | 8 160742 | | 6/1996 |
| JP | 11 179452 | | 7/1999 |
| JP | 2000 98738 | | 4/2000 |
| JP | 2000 121757 | | 4/2000 |
| JP | 2001-300658 | | 10/2001 |
| JP | 2001 356595 | | 12/2001 |
| JP | 2002-102955 | | 4/2002 |
| JP | 2004 93672 | | 3/2004 |
| JP | 2004191529 | A * | 7/2004 |

* cited by examiner conical shape

V-shape inner clip washer

DEVELOPER-CONTROLLING MEMBER, MANUFACTURING METHOD THEREOF, DEVELOPING MACHINE USING THE DEVELOPER-CONTROLLING MEMBER, IMAGE FORMING APPARATUS OR PRINTER USING THE DEVELOPING MACHINE, AND JOINTED PLATE

BACKGROUND OF THE INVENTION

1. Technical Field

The present invention relates to an improvement in a developer-controlling member for controlling the amount of toner to be supplied to a latent image carrier, facing a developing roller for supplying the toner toward the latent image carrier while absorbing the toner by a magnetic force of a magnet roller. Furthermore, the present invention relates to a method for manufacturing the developer-controlling member, a developing machine using the same, an image forming apparatus or a printer such as a copy machine, facsimile and the like using the developing machine, and a jointed plate.

2. Related Art Statement

Conventionally, an image forming apparatus or printer has been provided with a developing machine including a developing roller for absorbing magnetic carrier and toner by a magnetic force of a magnet roller to supply the toner toward a latent image carrier, and a developer-controlling member (developing doctor) facing the developing roller, for controlling the amount of toner to be supplied to the latent image carrier (for example, reference to Japanese Patent Laid-Open 2000-98738).

This type of developing machine is used for a color copy machine, for example. The developing machine comprises a developing roller 1 and a developer-controlling member 2 as shown in FIGS. 1, 2. The developing roller 1 and the developer-controlling member 2 are provided in a developing casing (not shown).

The developing roller 1 includes a developing sleeve 3 and a magnet roller 4. The developing sleeve 3 and the magnet roller 4 are integrally rotated by a driving shaft 5.

The developer-controlling member 2 comprises a nonmagnetic plate 6 as a controlling plate and a magnetic plate 7 as a holding plate. The magnetic plate 7 is mounted onto the nonmagnetic plate 6. While developer 9 comprising magnetic carrier and toner is absorbed to the developing roller 1 by a uniform magnetic field generated between the magnet roller 4 and the magnetic plate 7, the developer 9 is supplied toward a photoconductor drum 11 as a latent image carrier.

In the nonmagnetic plate 6, a ridge line 10 faces the outer circumference of the developing sleeve 3. A gap G is formed between the sleeve 3 and the ridge line 10. The ridge line 10 of the nonmagnetic plate 6 has a role for controlling the supply of the absorbed developer 9 in order to stabilize an image quality.

Moreover, in the developer-controlling member 2, the holding plate and controlling plate comprise a metal plate, respectively. As a method for mounting the controlling plate onto the holding plate, there has been known a method for forming a fitting projection on the holding plate by half-blanking the holding plate, forming a fitting hole on the controlling plate, and holding after positioning the controlling plate onto the holding plate (for example, Japanese Patent-Laid-Open H08-160742).

Meanwhile, in order to uniform the supply of the toner 9 by the developer-controlling member 2, a constant gap G is necessary in the longitudinal direction of the developing roller. Therefore, the straightness of the ridge line 10 of the nonmagnetic plate 6 is required. In this case, the straightness is linearity in the longitudinal direction of the ridge line 10 of the nonmagnetic plate 6. As shown in FIG. 3, the straightness is evaluated by using the amount of irregularity Δ L with respect to the reference point O of the point P1 that the straight line L1 included in the plane S1 having the ridge line 10 of the nonmagnetic plate 6, and in the direction orthogonal to the extending direction of the ridge line 10 intersects with the ridge line 10.

In the invention disclosed in the Japanese Patent Laid-Open H08-160742, the supply of the developer 9 can be uniformed by the developer-controlling member 2. However, it is necessary to conduct a screw fastening operation when mounting the controlling plate onto the holding plate, so that an assembly operation is not effectively conducted. When the holding plate comprises the nonmagnetic plate 6 and the controlling plate comprises the magnetic plate 7, the assembly operation is not also effectively conducted.

As an operation for mounting the magnetic plate 7 onto the nonmagnetic plate 6, there has been known various means such as spot welding, YAG laser welding and bonding in addition to the above operation. However, it is difficult for the mounting operation by the spot welding to ensure the straightness because of the generation of the welding strains. Therefore, it is difficult to correspond to an image forming apparatus requiring a high image quality.

In the mounting operation by the YAG laser welding means, it is easy to correspond to the image forming apparatus requiring a high image quality because the welding strains are less; however, an installation cost is high. In addition, the welding is conducted by providing a plurality of welding points spacing in the longitudinal direction of the nonmagnetic plate 7, so that the welding operation is not effectively conducted.

In the mounting operation by the bonding means, it is necessary to perform various controls regarding adhesive agent, manufacture of a bonding jig, bonding time and the like. Therefore, it is not effective from the aspect of endurance and time.

DISCLOSURE OF INVENTION

It is, therefore, an object of the present invention to provide a developer-controlling member, manufacturing method thereof, developing machine using the developer-controlling member, image forming apparatus or printer using the developing machine, and jointed plate, which are capable of increasing productive efficiency when a fitting projection is formed on a nonmagnetic plate by a half blanking process to mount a magnetic plate onto the nonmagnetic plate by using the fitting projection, and positively contributing to maintenance of the straightness of the nonmagnetic plate.

To achieve the above object, in one embodiment of the present invention, a developer-controlling member comprises a first plate, and a second plate attached to the first plate, the first and second plates being formed to extend in a longitudinal direction of a developing roller including a magnet roller, wherein a half blanking fitting projection is formed on one of the first and second plates, a fitting hole fitting to the fitting projection is formed in the other of the first and second plates, and the first and second plates are fastened by caulking the fitting projection.

Preferably, the first plate comprises a magnetic plate and the second plate comprises a nonmagnetic plate.

In one embodiment of the present invention, a developer-controlling member comprises a magnetic plate and a nonmagnetic plate which extend in a longitudinal direction of a developing roller including a magnet roller, wherein a half blanking fitting projection is formed on one of the nonmagnetic plate and the magnetic plate, a fitting hole fitting to the fitting projection is formed on the other of the nonmagnetic plate and the magnetic plate, and the magnetic plate and the nonmagnetic plate are fastened by caulking the fitting projection.

In one embodiment of the present invention, a developer-controlling member comprises a magnetic plate and a nonmagnetic plate which extend in a longitudinal direction of a developing roller including a magnet roller, wherein a plurality of half blanking fitting projections is formed on the nonmagnetic plate spacing in a longitudinal direction of the nonmagnetic plate, fitting holes fitting to the fitting projections are formed on the magnetic plate corresponding to the fitting projections, and the magnetic plate and the nonmagnetic plate are fastened by caulking respective fitting projections.

Preferably, a diameter of the fitting hole is slightly larger than a diameter of the fitting projection.

Preferably, a head portion of the fitting projection is collapsed by a V-shape punch to be divided into two.

Preferably, a direction of a collapsed groove formed on a head portion of the fitting projection is a direction orthogonal to the longitudinal direction of the nonmagnetic plate.

Preferably, the fitting projection is a circular shape, and an annular groove for absorbing a deformation of the magnetic plate when collapsing a head portion of the fitting projection is formed to surround an outer circumference of an elementary part of the fitting projection.

Preferably, a distance from a center portion of the fitting projection to a ridge line facing the developing roller of the nonmagnetic plate is twice and above of a diameter of the fitting projection.

In one embodiment of the present invention, a die comprises a die button facing a forming punch for forming a half blanking fitting projection by applying a pressurizing force to a nonmagnetic plate, so as to form the half blanking fitting projection spacing in a longitudinal direction of the nonmagnetic plate and an annular groove in an elementary part of the fitting projection.

In one embodiment of the present invention, a method for manufacturing a developer-controlling member comprises a half blanking step of forming a plurality of half blanking fitting projections on a nonmagnetic plate extending in a longitudinal direction of a developing roller including a magnet roller, spacing in a longitudinal direction of the nonmagnetic plate, and forming an annular groove surrounding an outer circumference of an elementary part of the fitting projection; a setting step of setting the magnetic plate on the nonmagnetic plate by fitting respective fitting holes of the magnetic plate including the fitting holes formed by corresponding to the fitting projections to the fitting projection; and a step of collapsing the fitting projection by applying a pressurizing force to a head portion of the fitting projection by a forming punch having a V-shape head portion with a state that the magnetic plate is set on the nonmagnetic plate.

In one embodiment of the present invention, a developing machine comprises the developer-controlling member of one embodiment of the present invention.

In one embodiment the present invention, an image forming apparatus comprises the developing machine of one embodiment of the present invention.

In one embodiment of the present invention, a printer comprises the developing machine of one embodiment of the present invention.

In one embodiment of the present invention, a jointed plate includes a first long plate comprising a nonmagnetic metal; and a second long plate comprising a metal plate having a thickness different from the first long plate, wherein a half blanking fitting projection is formed on the first long plate, a fitting hole fitting to the fitting projection is formed on the second long plate, and the fitting projection and fitting hole are fitted such that the first long plate and the second long plate are fastened by caulking the fitting projection.

In one embodiment of the present invention, a jointed plate includes a first long plate comprising a plastic material; and a second long plate comprising a metal plate having a thickness different from the first long plate, wherein a fitting projection is formed on the first long plate, a fitting hole fitting to the fitting projection is formed on the second long plate, and the fitting projection and the fitting hole are fitted such that the fitting projection is caulked by thermal caulking.

Preferably, a sharp angle-shaped piece is formed in a peripheral wall of the fitting hole of the second long plate or a radially cut piece is formed in the peripheral wall of the fitting hole of the second long plate.

Preferably, a half blanking fitting hole is formed on the long plate having a thickness thicker than the other.

In one embodiment of the present invention, a jointed plate comprises a first long plate and a second long plate, wherein a half blanking swelling projection extending in a longitudinal direction of the first long plate is formed on the first long plate, an elongate hole fitting to the swelling projection is formed on the second long plate, and the swelling projection is fitted into the elongate hole such that caulking portions are formed on the swelling portion spacing in a longitudinal direction of the swelling portion to fasten the first long plate and the second long plate.

EFFECTS OF THE INVENTION

According to the developer-controlling member and the manufacturing method thereof in one embodiment of the present invention, when the fitting projection is formed on the magnetic plate by the half blanking process to mount the magnetic plate onto the nonmagnetic plate by using the fitting projection, the production efficiency can be improved. Therefore the developer-controlling member and the manufacturing method thereof in one embodiment of the present invention can positively contribute to the maintenance of the straightness of the nonmagnetic plate.

According to the developer-controlling member in one embodiment of the present invention, the production efficiency can be improved while positively contributing to the improvement in the straightness of the ridge line of the nonmagnetic plate.

According to the developer-controlling member in one embodiment of the present invention, the production efficiency can be improved while further positively contributing to the improvement in the straightness of the nonmagnetic plate. In addition, the peripheral wall of the peripheral wall of the magnetic plate is deformed in the direction that the fitting hole is pressed into the annular groove by the collapsing of the fitting projection, so that the closely-attached strength of the magnetic plate to the nonmagnetic plate is increased. Accordingly, the clearance is reduced between the magnetic plate and the nonmagnetic plate, and the bonding of the developer into the clearance is prevented.

According to the developer-controlling member in one embodiment of the present invention, the width of the magnetic plate can be reduced while maintaining the straightness of the nonmagnetic plate; thus, also the absorbing amount of the developer can be stabilized.

According to the die in one embodiment of the present invention, the half blanking fitting projection can be formed on the nonmagnetic plate while forming the fitting projection in a predetermined shape.

According to the developing machine, image forming apparatus and printer in one embodiment of the present invention, an image quality can be further improved.

These and other objects and advantages of the present invention will become apparent from the following description, drawings and claims.

PRIORITY CLAIM

This application claims the benefit of priority to Japanese Patent Application No. 2004-286288 filed on Sep. 30, 2004 and Japanese Patent Application No. 2004-376741 filed on Dec. 27, 2004, which are hereby incorporated by reference.

BEST MODE FOR CARRYING OUT THE INVENTION

Hereinafter, an embodiment of a developer-controlling member, manufacturing method of the developer-controlling member, developing machine using the developer-controlling member and image forming apparatus using the developing machine according to one embodiment of the present invention will be described with reference to the drawings.

Embodiment

Figure 1:
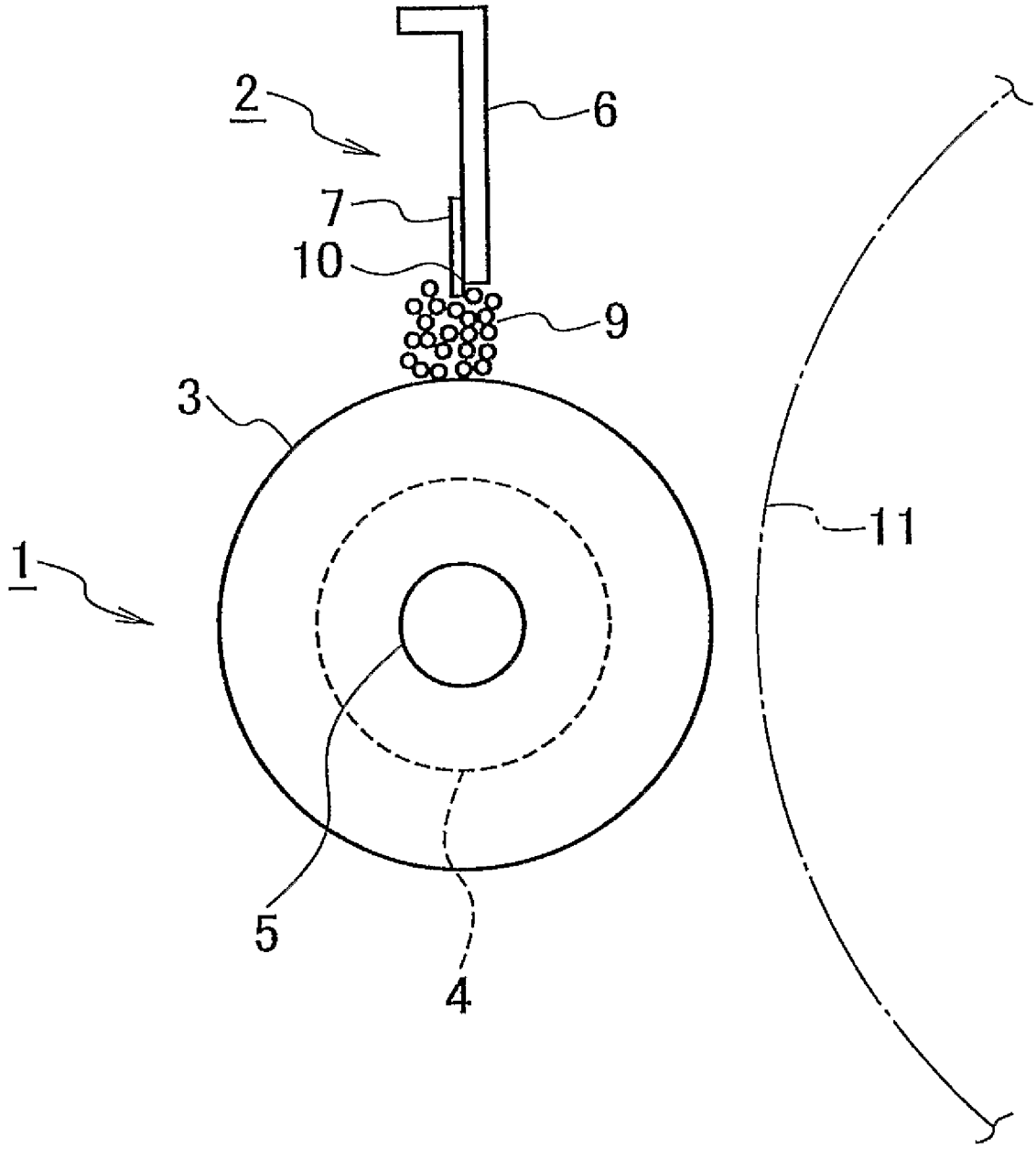
FIG. 1 is a side view showing a schematic structure of relevant portions of a conventional developing machine.
Figure 2:
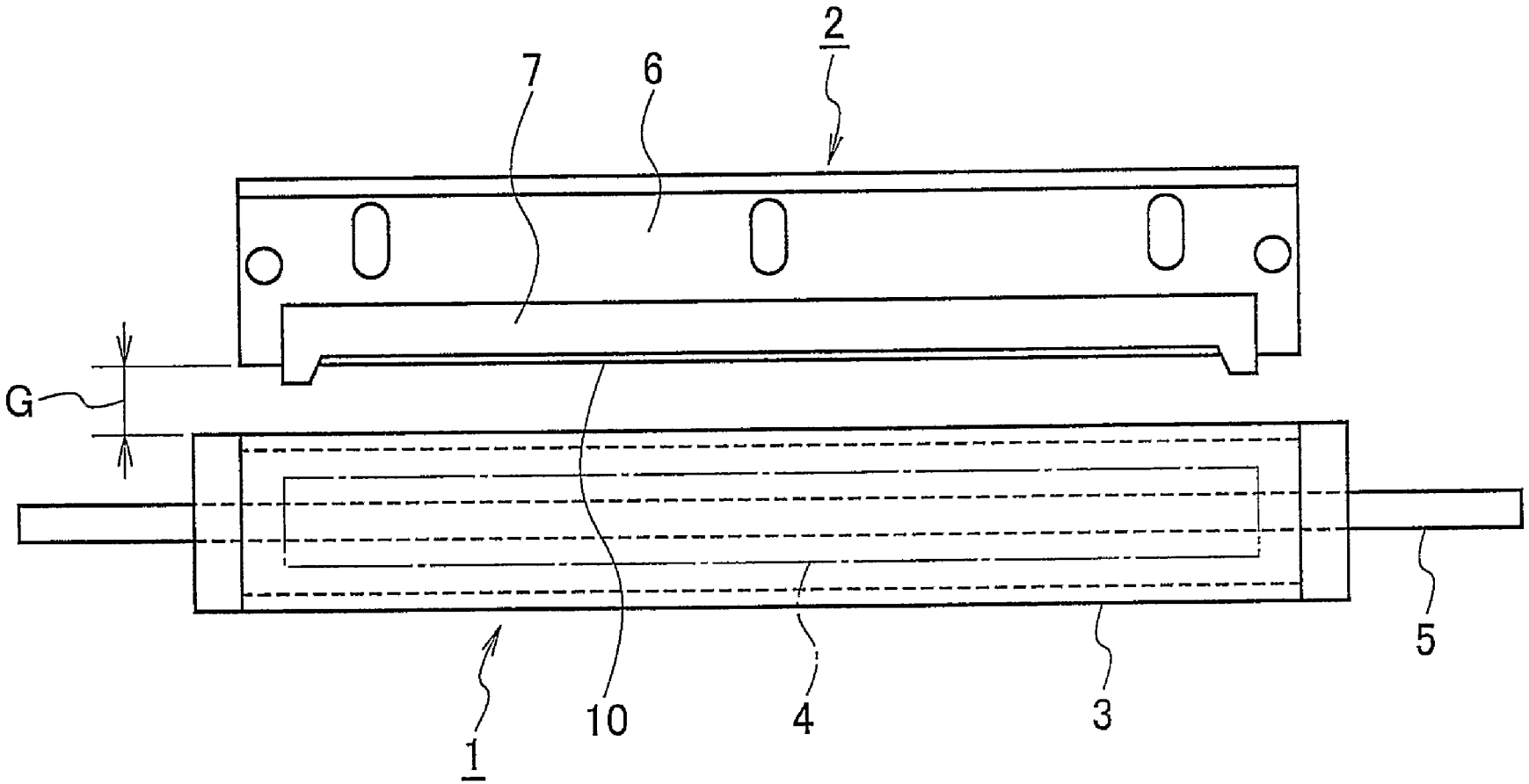
FIG. 2 is a front view of the developing machine shown in FIG. 1.
Figure 3:
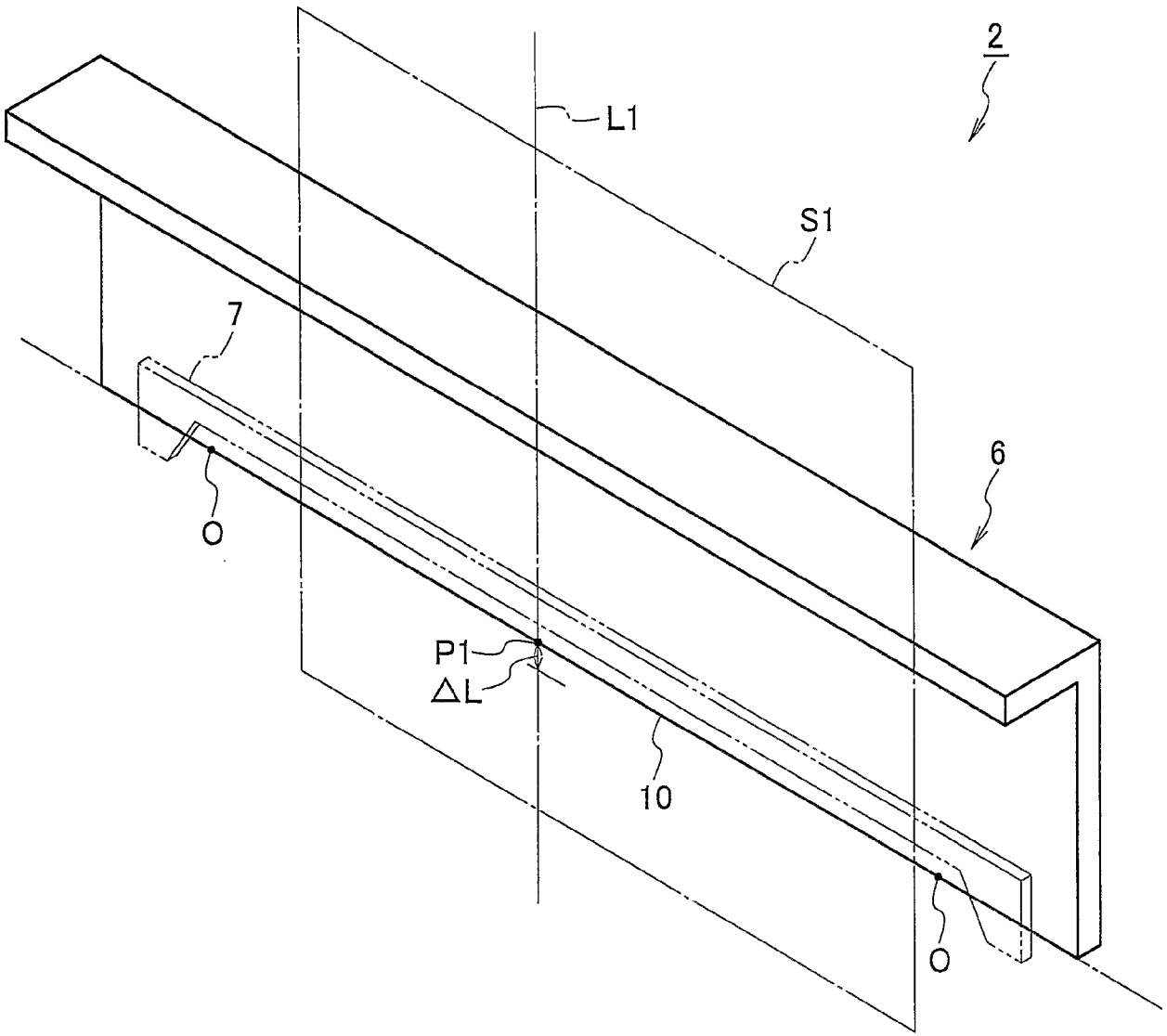
FIG. 3 is a perspective view illustrating a schematic structure of the developer-controlling member shown in FIG. 1.
Figure 4:
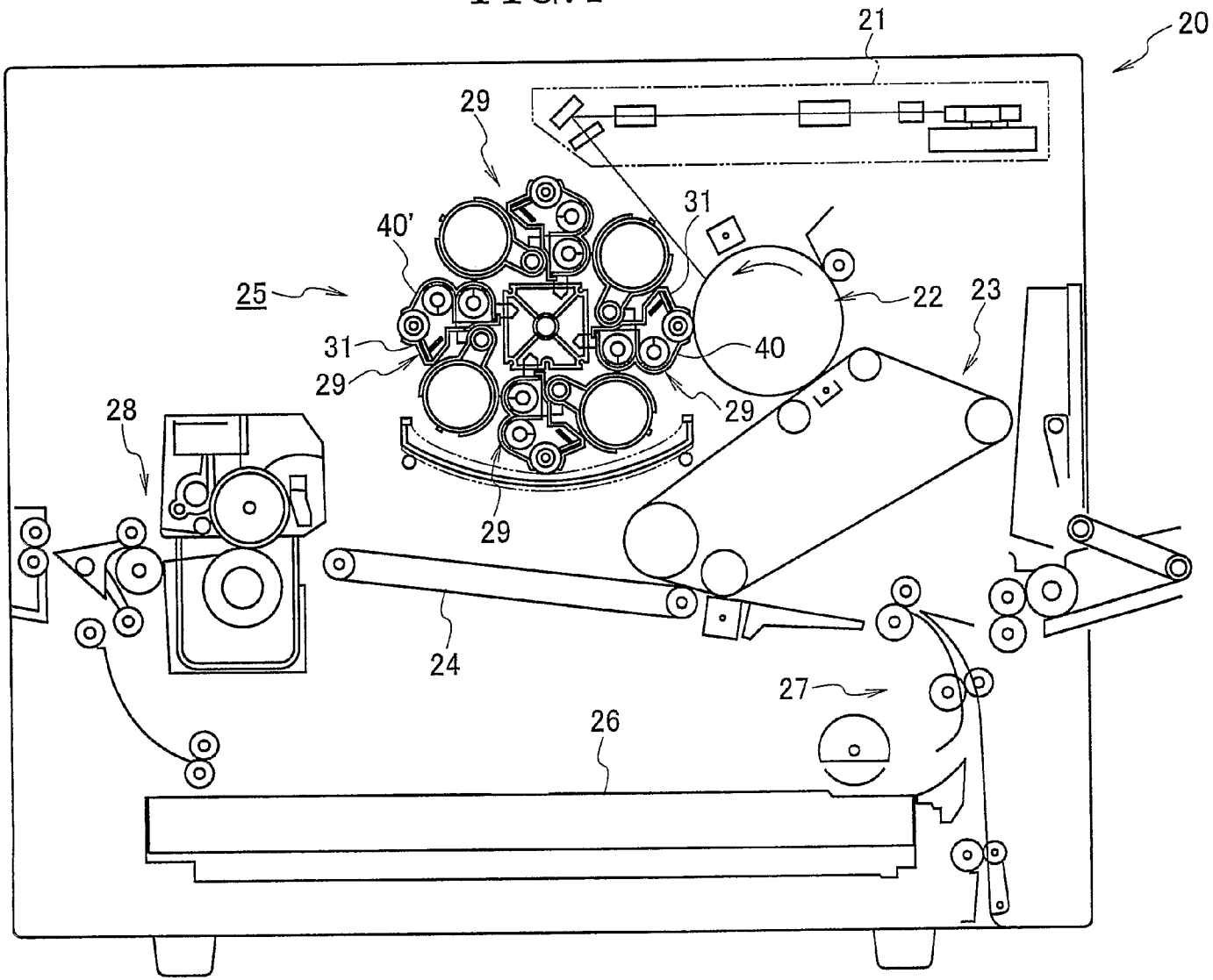
FIG. 4 is a schematic view illustrating an image forming apparatus in which a developing machine according to the present invention is installed.

FIG. 4 is a schematic view illustrating one example of an image forming apparatus including a developer-controlling member according to one embodiment of the present invention. In FIG. 4, a reference numeral 20 denotes a color copy machine as an image forming apparatus. The color copy machine 20 includes a writing unit 21 having a laser light source, polygon mirror, fθ lens and the like, a photoconductor drum 22 as a latent image carrier, an intermediate transfer belt 23, a transport belt 24, a revolver developing device 25, a transfer paper tray 26, a feeding roll mechanism 27 and a discharging roll mechanism 28.

The revolver developing device 25 has developing machines 29 respectively storing a toner (developer) corresponding to each color of Y, M, C and K. Each developing machine 29 faces the photoconductor drum 22 according to need, and a developer 9 is supplied to the photoconductor drum 22. The detailed structure of the revolver developing device 25 is disclosed in the Japanese Patent Laid-Open 2000-98738.

Figure 5:
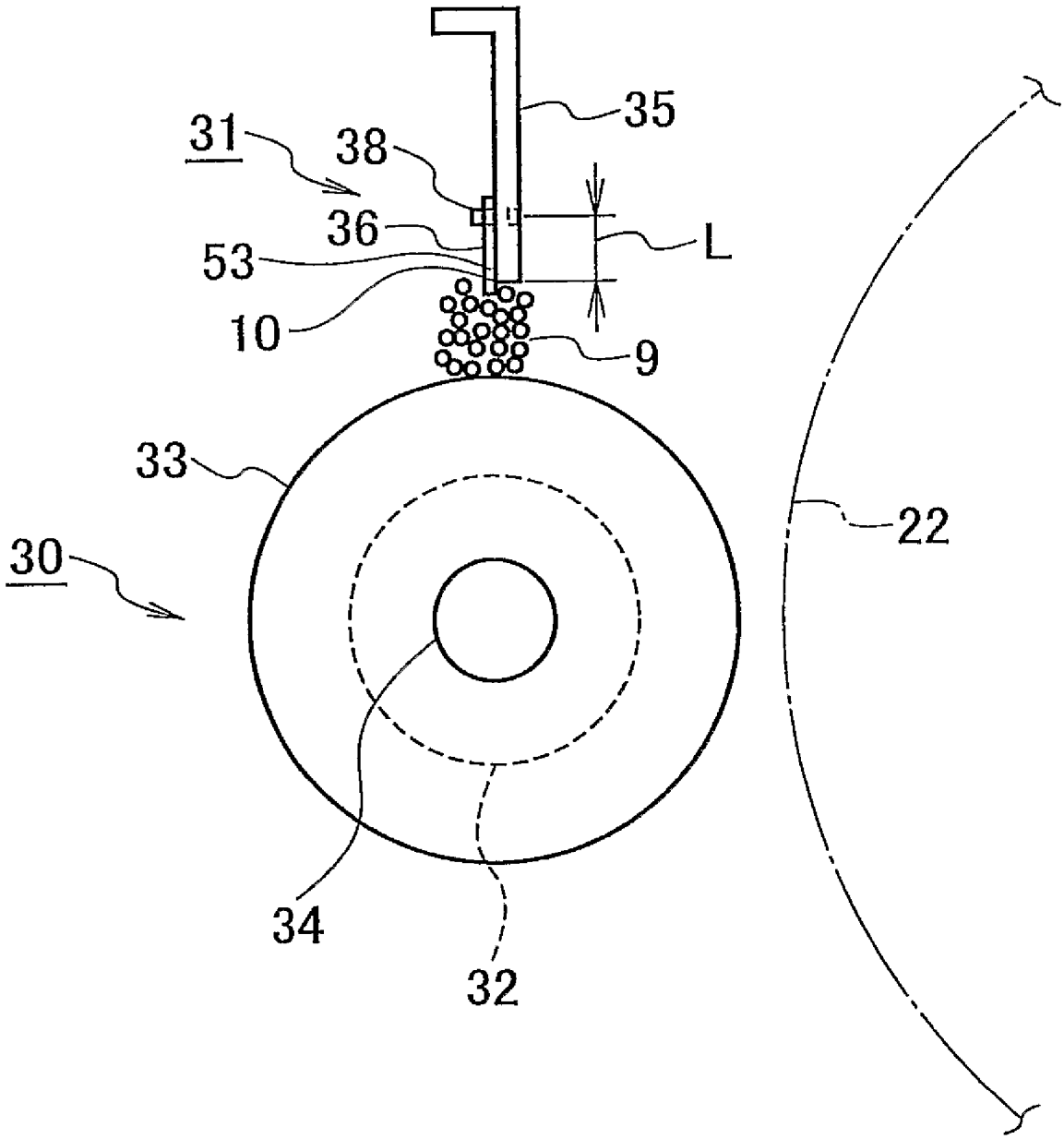
FIG. 5 is a partly enlarged side view showing a photoconductor drum and relevant portions of a developing machine according to the present invention.
Figure 6:
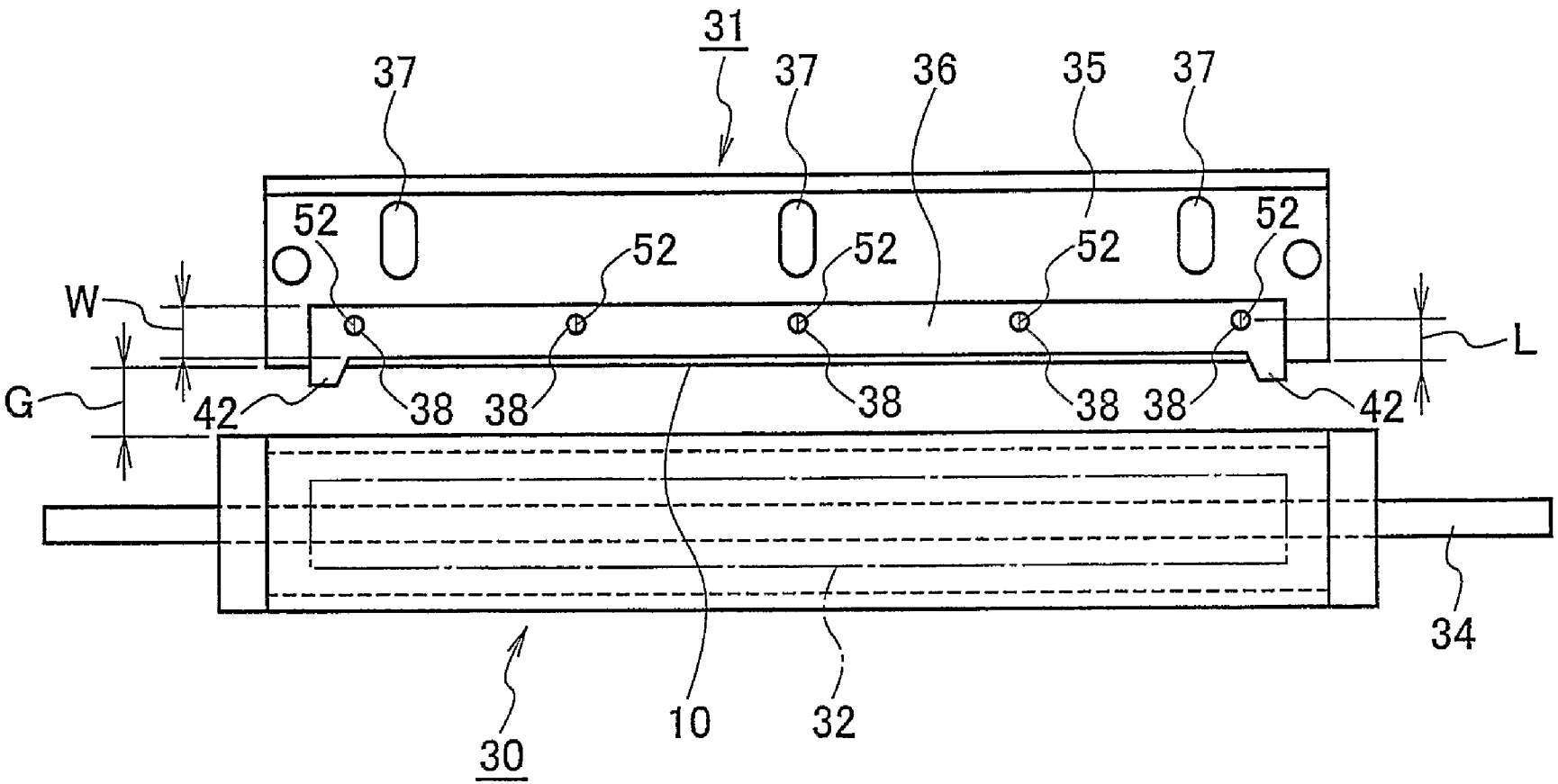
FIG. 6 is a front view of the developing machine shown in FIG. 5.

Each developing machine 29 is provided with a developing roller 30 and a developer-controlling member 31 having a structure shown in FIGS. 5, 6. The developing roller 30 comprises a magnet roller 32 and a developing sleeve 33. The developing sleeve 33 is provided with a driving shaft 34.

The developer-controlling member 31 comprises a nonmagnetic plate 35 of reversed L-shape and a magnetic plate 36. A material such as SUS 304 and 316 is used for the nonmagnetic plate 35, for example. A material such as SUS 430 is used for the magnetic plate 36, for example. The thickness of the magnetic plate 36 is thinner than the thickness of the nonmagnetic plate 35. The thickness of the nonmagnetic plate 35 is, for example, 1 mm to 3 mm, and the thickness of the magnetic plate 36 is, for example, 0.1 mm to 0.3 mm.

The nonmagnetic plate 35 is formed with mounting holes 37 at the both end portions and the center portion. The mounting holes 37 are used when the developer-controlling member 31 is mounted on a casing 40' of the developing machine 29 by means of a fastening screw (not shown).

Figure 7:
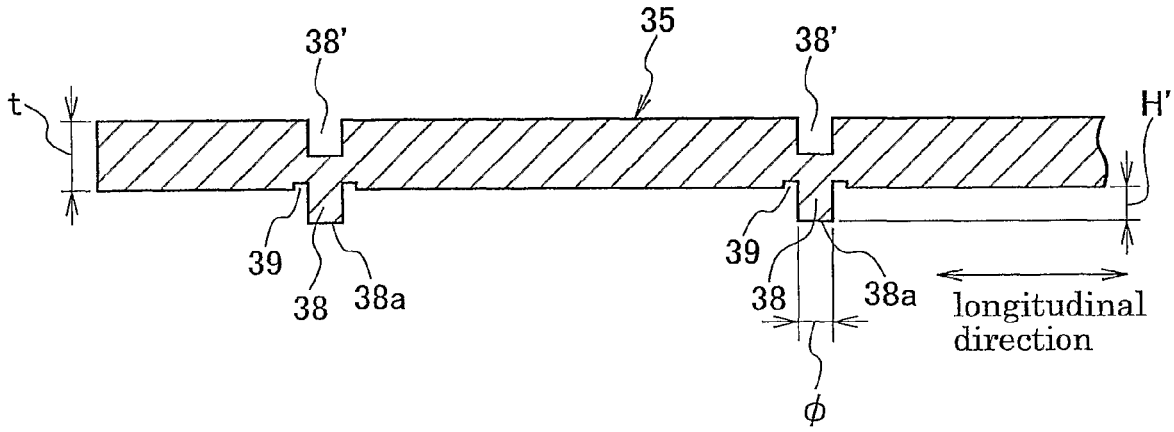
FIG. 7 is an enlarged cross section view illustrating a part of the nonmagnetic plate shown in FIG. 5.

The nonmagnetic plate 35 is formed with a plurality of half blanking fitting projections 38 in the longitudinal direction of the developing roller 30 with a predetermined interval as shown in the enlarged view of FIG. 7. The fitting projection 38 is a cylindrical shape. The elementary part of fitting projection 38 of the nonmagnetic plate 35 is formed with an annular groove 39 surrounding the fitting projection 38.

Figure 8:
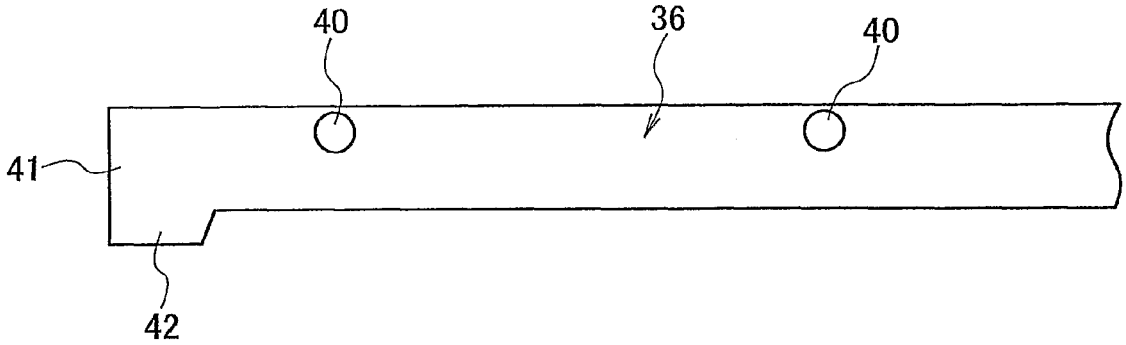
FIG. 8 is an enlarged plan view showing a part of the magnetic plate shown in FIG. 5.

The magnetic plate 36 extends along the longitudinal direction of the nonmagnetic plate 35 as illustrated in the enlarged view of FIG. 8. The magnetic plate 36 is formed with a fitting hole 40 corresponding to the fitting projection 38. The diameter of the fitting hole 40 is slightly larger than the diameter of the fitting projection 38, so that the magnetic plate 36 can be easily set to the nonmagnetic plate 35. The magnetic plate 36 is formed with projections 42, 42 at the both end portions 41 in the longitudinal direction of the magnetic plate 36.

Because the magnetic force is concentrated in the both end portions of the magnetic plate 36, the developer 9 is over absorbed by the concentration of the magnetic force, so that the developer 9 is over supplied to the both end portions compared with the center portion of the magnetic plate 36. Therefore, the projections 42, 42 are used to control the supply of the developer 9.

Figure 9:
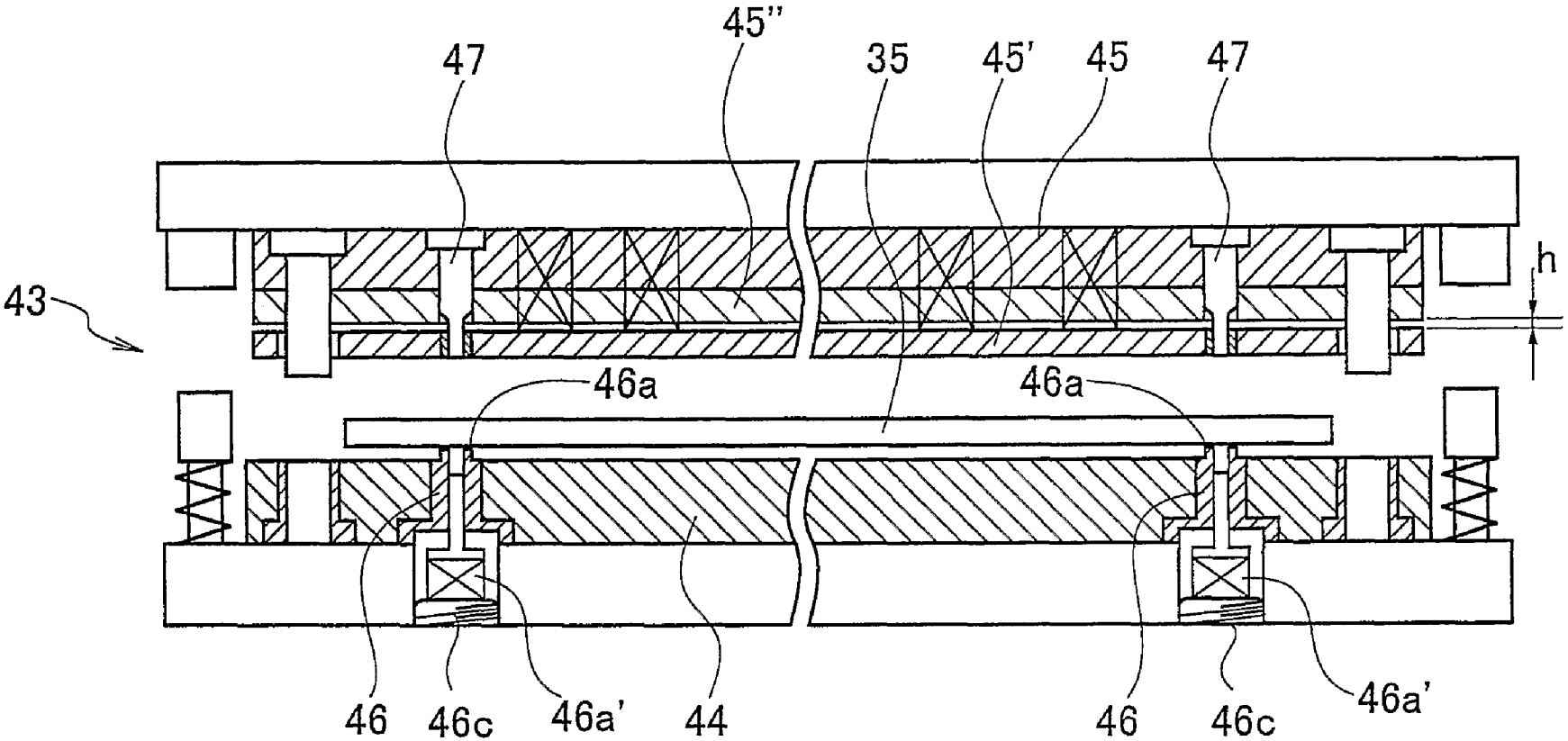
FIG. 9 is a schematic view illustrating a die for forming a half blanking fitting projection on the nonmagnetic plate illustrated in FIG. 7.

The fitting projection 38 is formed on the nonmagnetic plate 35 by using a die 43 shown in FIG. 9, for example. The die 43 includes a die plate 44, punch plate 45, stripper 45' and body plate 45". An upper die comprising the punch plate 45, stripper 45' and body plate 45" moves in the up and down direction with respect to the die plate 44. The die plate 44 is provided with a plurality of cylindrical die buttons 46 spacing in the direction corresponding to the longitudinal direction of the nonmagnetic plate 35.

Figure 10:
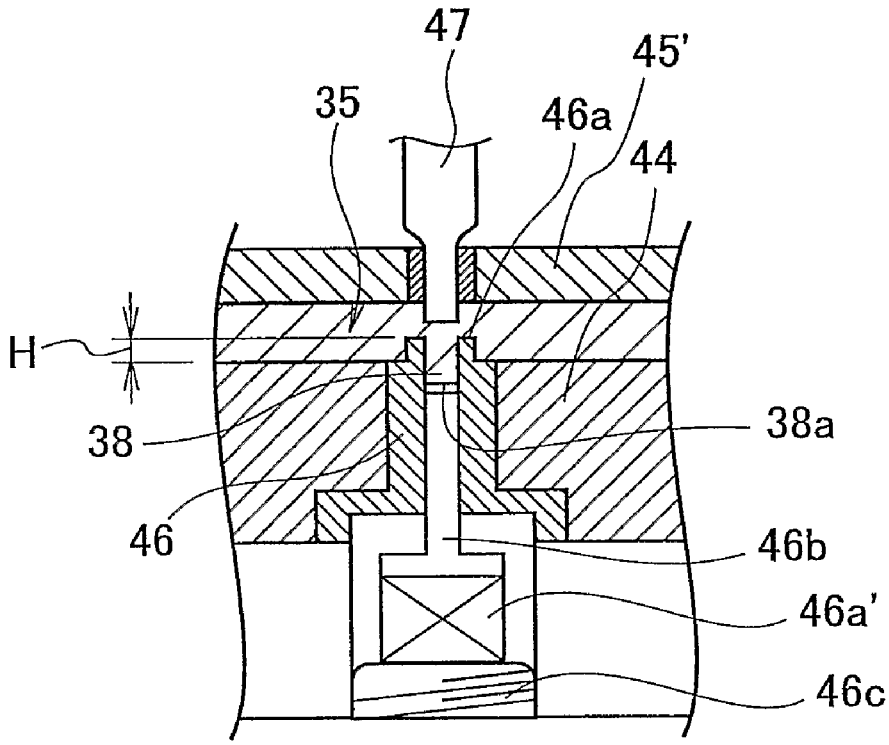
FIG. 10 is a cross section view illustrating a part of the detailed structure of the die bottom shown in FIG. 9.

The die button 46 includes a projection end portion **46*a*. The projection height H (reference to FIG. 10) of the projection end portion 46*a* from the top surface of the die plate 44 is about 50 μm. The punch plate 45 is provided with a forming punch 47 of cylindrical shape corresponding to the die button 46 as illustrated in FIG. 9. The nonmagnetic plate 35 is set to the die plate 44, and is pressurized by the forming punch 47 while being sandwiched by the punch plate 45, stripper 45' and the die plate 44, as illustrated in FIG. 9**.

Accordingly, as shown in FIG. 7, in the nonmagnetic plate 35, a dent 38' is formed onto the plane facing the forming punch 47 and the portion pressurized by the forming punch 47, and the plane opposite to the above plane and the portion pressurized by the forming punch 47 are pushed into the tube of the die button 46 to form the fitting projection 38 of half blanking shape. The fitting projection 38 is cut into the tube of the die button **46*a*, and the strength in the direction getting out of the tube of the die button 46 acts on the fitting projection 38 by a screw 46' and ejection pin 46 as illustrated in the enlarged view of FIG. 10. The above mentioned projection height H is determined by the distance h between the body plate 45" and the stripper 45'. In addition a reference numeral 46*c* denotes a locking screw in FIG. 10**.

The annular groove 39 is formed of the projection end portion **46*a* of the die button 46. The die button 46 forms the shape of the fitting projection 38. As illustrated in the partly enlarged view of FIG. 10, the elementary part of the cylindrical fitting projection 38** is, accordingly, formed without being plastically deformed.

Figure 11:
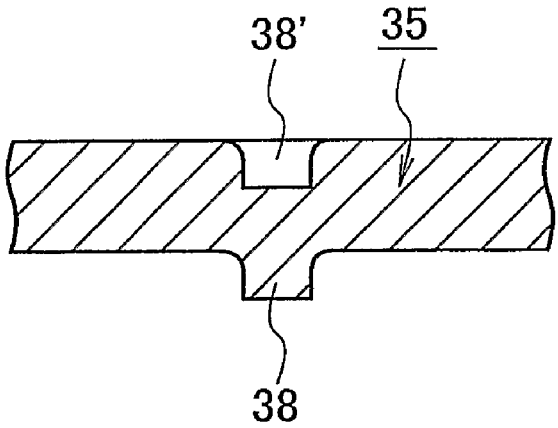
FIG. 11 is an enlarged cross section view of a fitting projection forming portion for explaining a failure when a half blanking projection is formed on a nonmagnetic plate without using the die bottom shown in FIG. 10.

Correspondingly, when the die button 46 is not provided in the die plate 44, the elementary part of the fitting projection 38 is plastically deformed as illustrated in the partly enlarged view of FIG. 11. According to the present embodiment, the plane having the fitting projection 38 to be the set plane of the magnetic plate 36 is, therefore, prevented from being plastically deformed. The fitting hole 40 is formed on the magnetic plate 36 by the known blanking.

Figure 12:
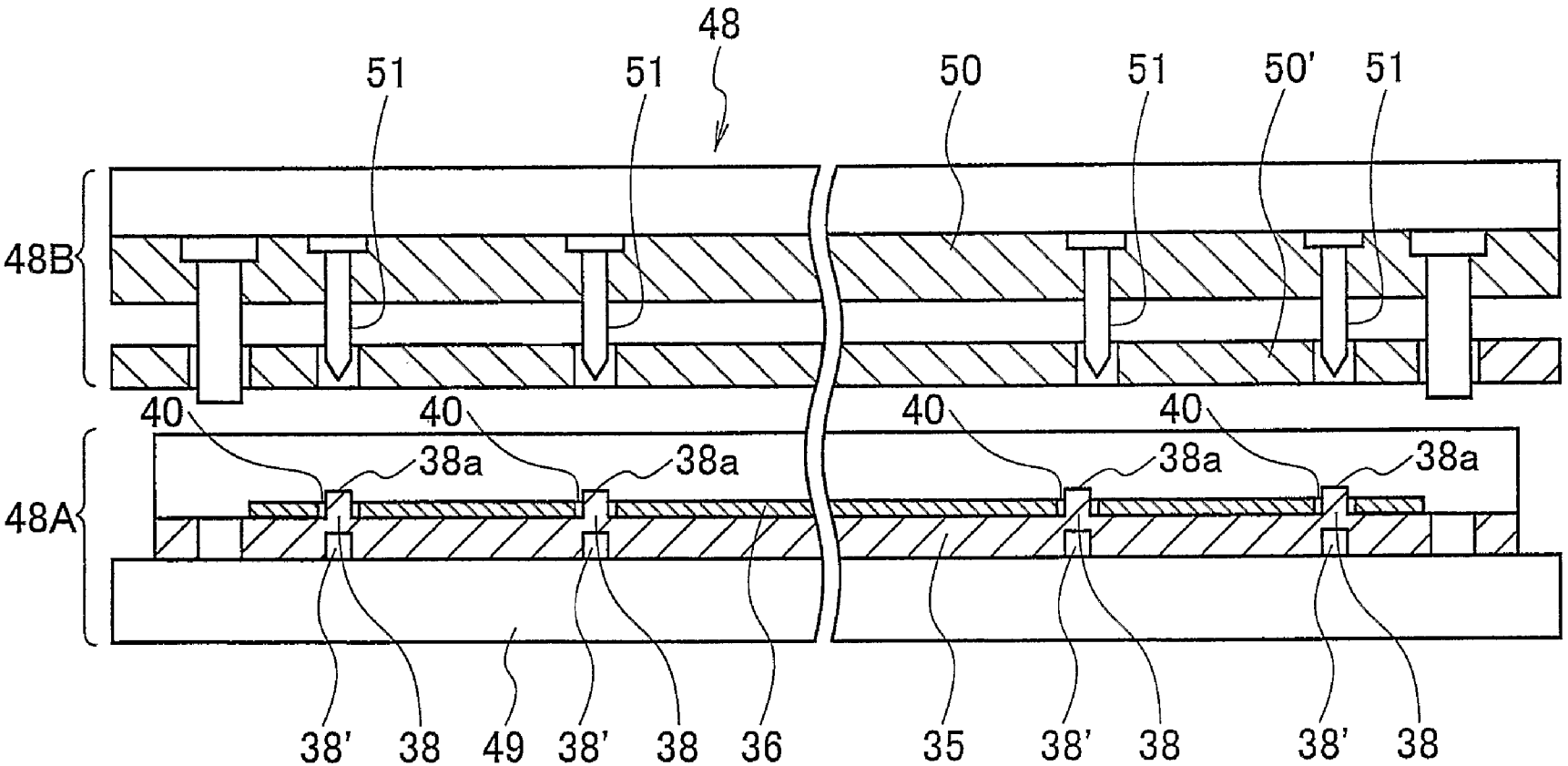
FIG. 12 is a schematic view showing one example of a caulking die used in a manufacture of the developer-controlling member illustrated in FIG. 6.

The magnetic plate 36 is fastened to the nonmagnetic plate 35 by using a caulking die 48 shown in FIG. 12. The caulking die 48 comprises a lower die 48A including a die plate 49 and an upper die 48B including a punch plate 50 and stripper 50'. The punch plate 50 is provided with a caulking punch 51 corresponding to the fitting projection 38.

Figure 13A:
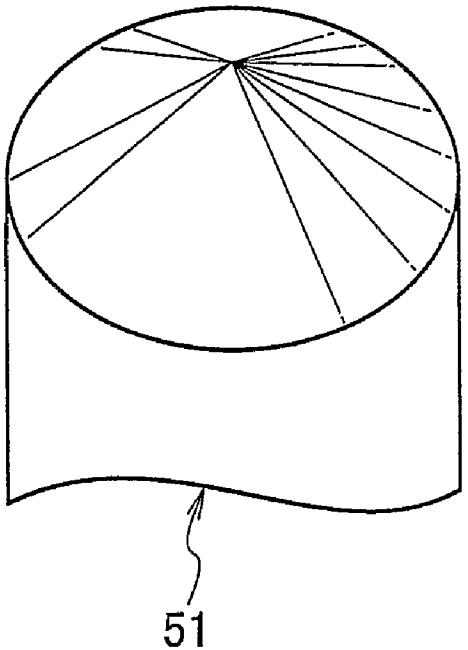
FIG. 13A is a perspective view showing a part of caulking punch having a conical-shaped head portion.
Figure 13B:
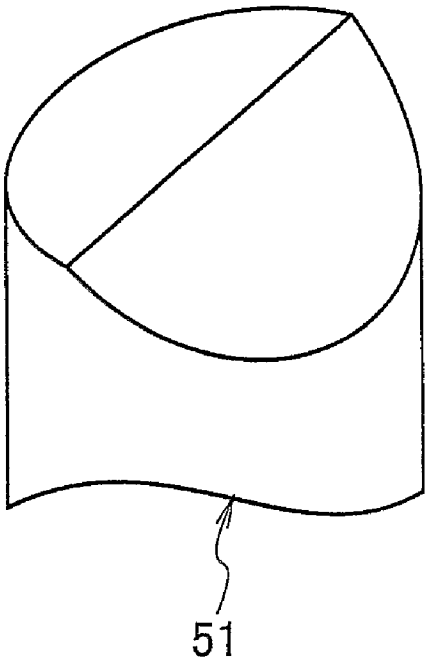
FIG. 13B is a perspective view showing a part of caulking punch having a V-shaped head portion.
Figure 13C:
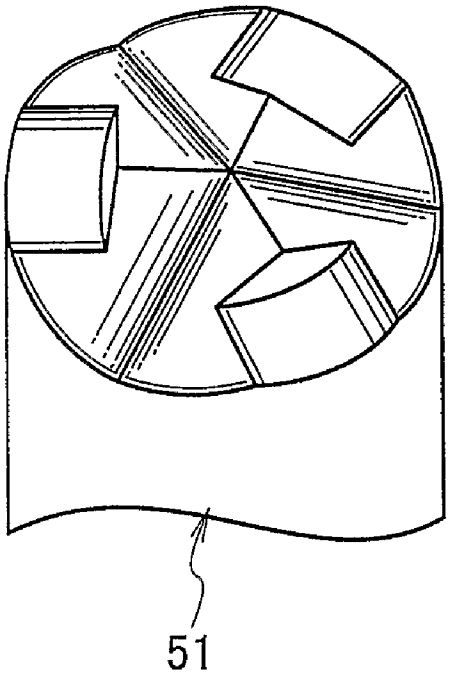
FIG. 13C is a perspective view showing a part of caulking punch having an inner clip washer shaped head portion.

In the caulking punch 51, the shape of the leading end can be a conical shape shown in FIG. 13A, a V-shape shown in FIG. 13B and an inner clip washer shape shown in FIG. 13C. However, it is preferable to use the V-shaped caulking punch 51 based on an after-mentioned reason. Preferably, the angle of V-shape is 120 degrees.

The nonmagnetic plate 35 is set to the die plate 49 such that the fitting projection 38 directs upwardly. Next, the fitting hole 40 of the magnetic plate 36 is fitted to the fitting projection 38 to set the magnetic plate 36 onto the nonmagnetic plate 35. Next, the upper die 48B is lowered. Accordingly, the nonmagnetic plate 35 and the magnetic plate 36 are pressurized and sandwiched by the stripper 50'. Next, the caulking punch 51 comes into contact with a head portion 38*a* of the fitting projection 38, the head portion 38*a* of the fitting projection 38 is collapsed to be divided into two, and then a collapsed groove 52 is formed onto the head portion 38*a* as illustrated in the enlarged view of FIGS. 14, 15.

Figure 16:
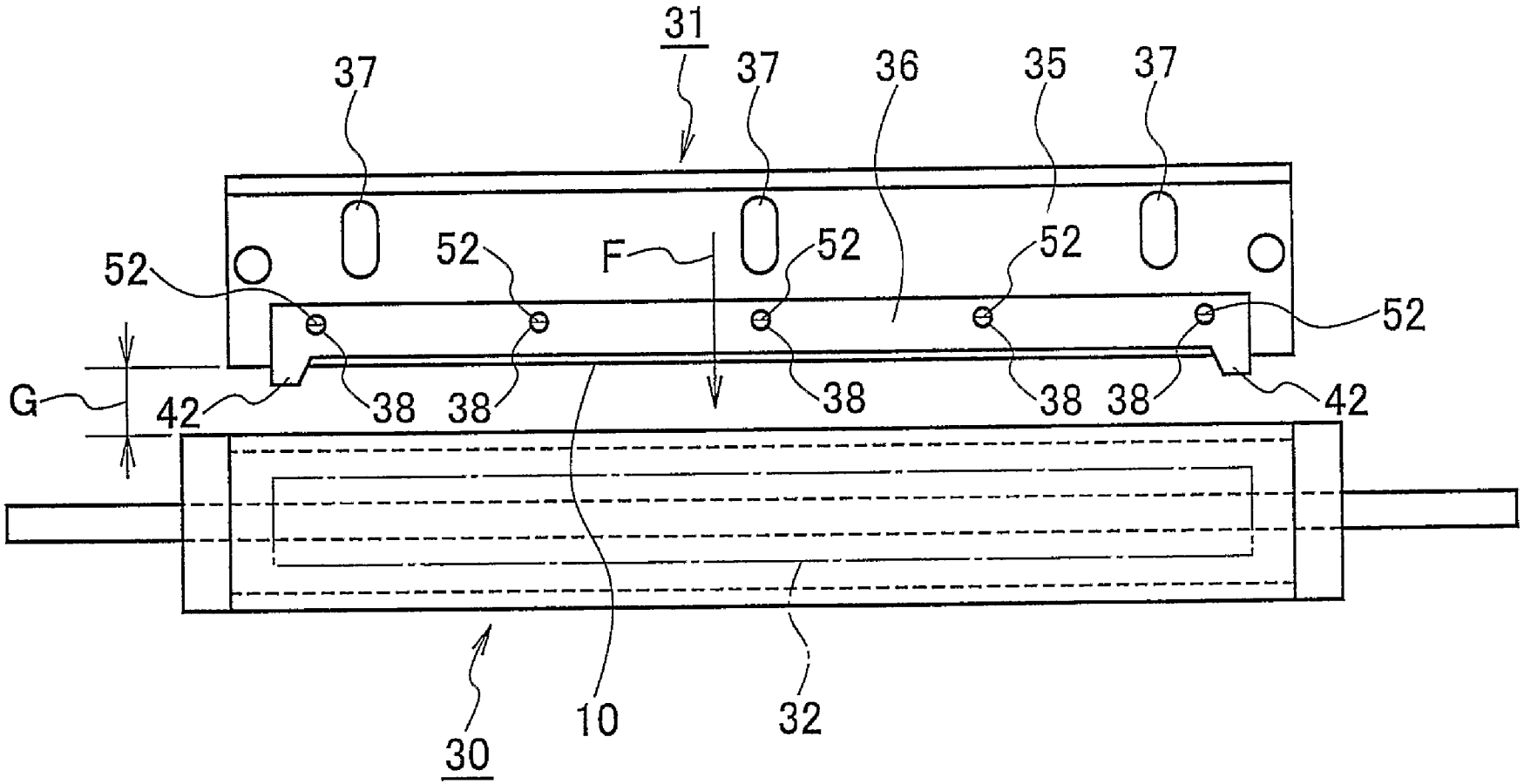
FIG. 16 is a front view illustrating a direction that a deformation force acts when the direction of the collapsed groove formed on the head portion of the fitting projection is adopted to be the direction parallel to the extending direction of the nonmagnetic plate.

It is preferable for the direction in which the collapsed groove 52 extends to be the direction orthogonal to the longitudinal direction of the nonmagnetic plate 35. If the direction in which the collapsed groove 52 extends is formed in the direction same as the direction in which the nonmagnetic plate 35 extends, the plastic deformation force F is mainly applied to the direction toward the ridge line 10 when collapsing the head portion 38*a* as shown in FIG. 16, so that the possibility having an influence on the straightness of the ridge line 10 is increased. More particularly, the direction of uneven thickness of the nonmagnetic plate 35 becomes the direction toward the ridge line 10, so that the straightness of the ridge line 10 is deteriorated.

Figure 17:
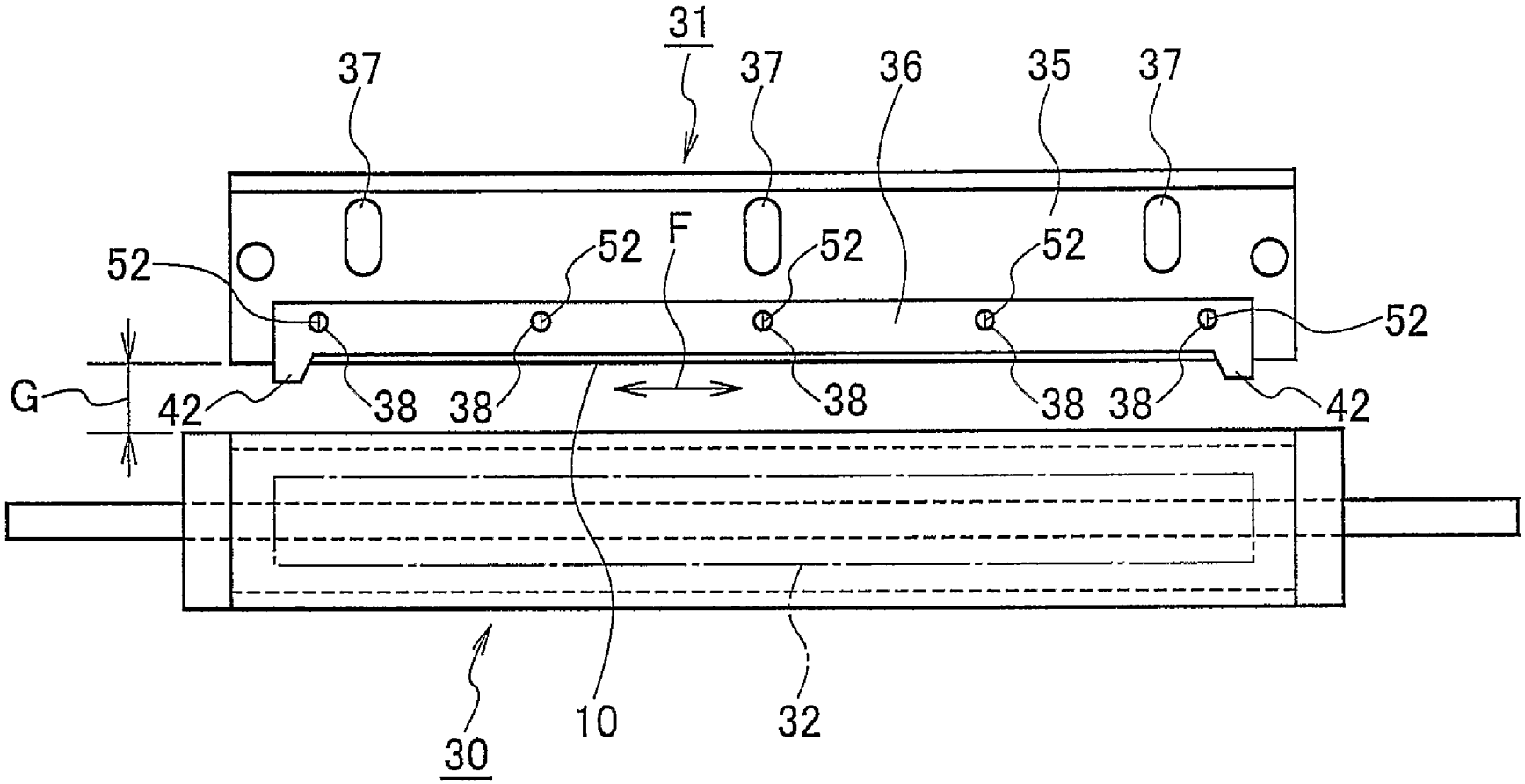
FIG. 17 is a front view illustrating the direction that the deformation force acts when the direction of the crashed groove formed on the head portion of the fitting projection is adopted to be an orthogonal to the direction that the nonmagnetic plate extends.
Figure 18:
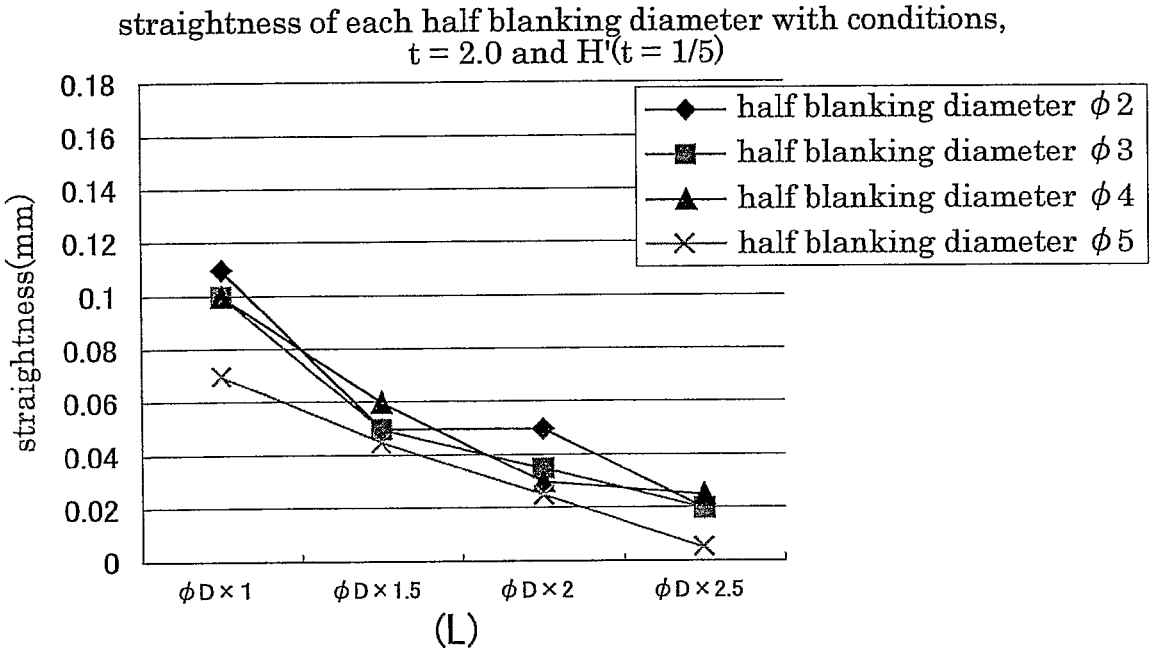
FIG. 18 is a graph of straightness obtained by changing the diameter of the fitting projection from 2 mm to 5 mm and the distance from the center of the fitting projection to the ridge line when the thickness of the nonmagnetic plate is 2.0 mm and the height of the fitting projection is ⅕ of the thickness.
Figure 19:
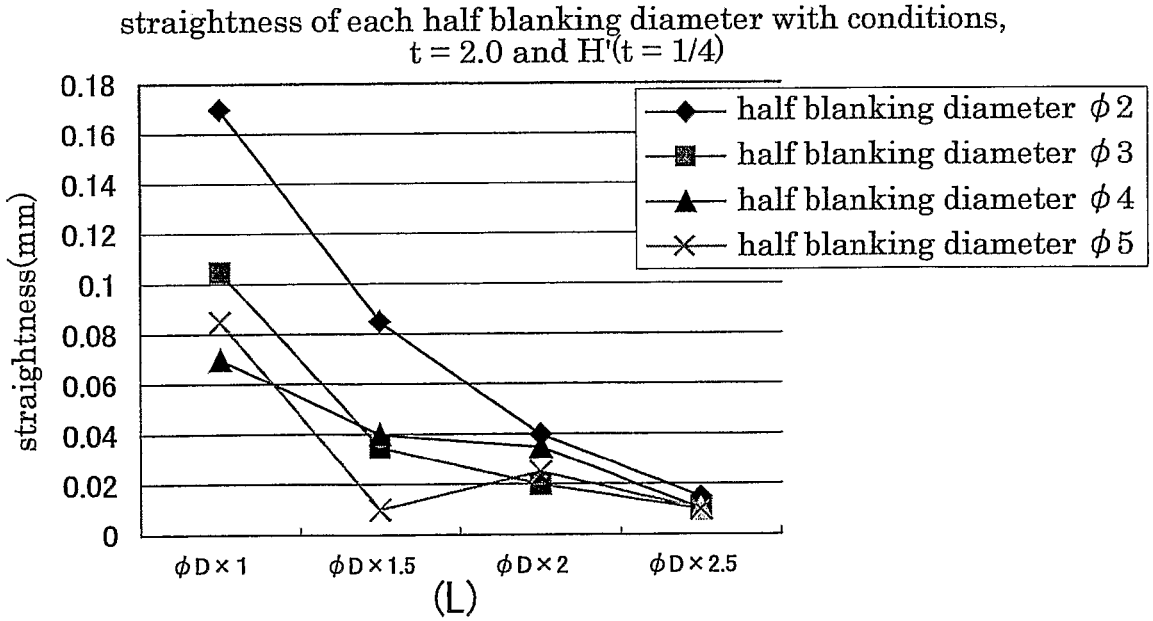
FIG. 19 is a graph of straightness obtained by changing the diameter of the fitting projection from 2 mm to 5 mm and the distance from the center of the fitting projection to the ridge line when thickness of the nonmagnetic plate is 2.0 mm and the height of the fitting projection is ¼ of the thickness.
Figure 20:
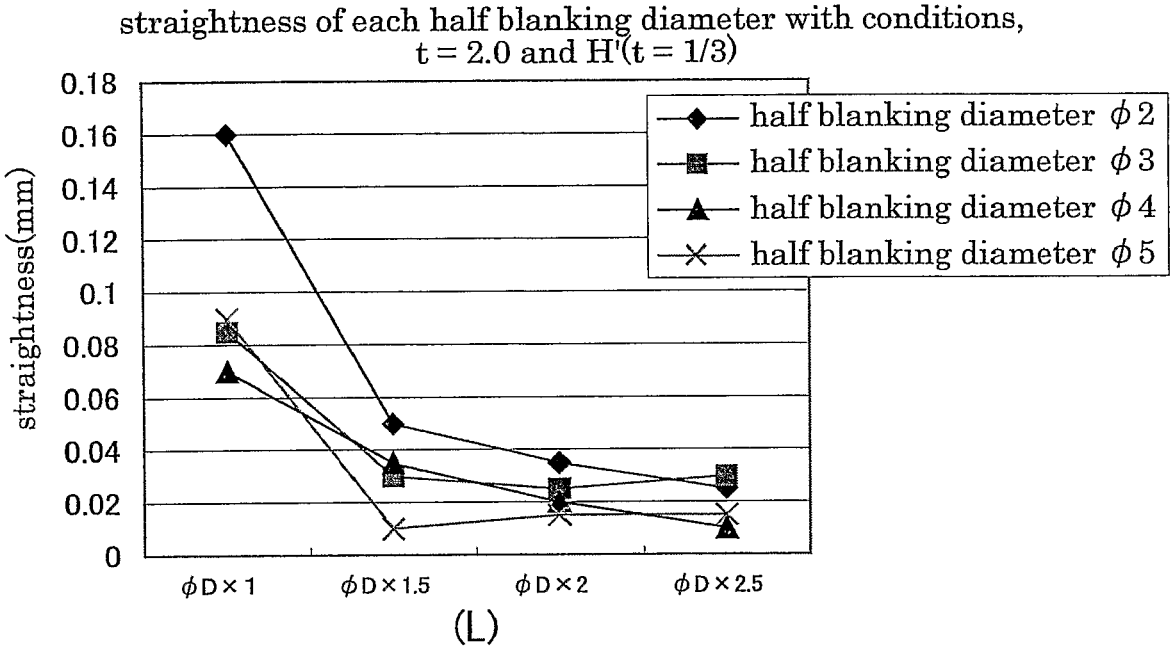
FIG. 20 is a graph of straightness obtained by changing the diameter of the fitting projection from 2 mm to 5 mm and the distance from the center of the fitting projection to the ridge line when the thickness of the nonmagnetic plate is 2.0 mm and the height of the fitting projection is ⅓ of the thickness.
Figure 21:
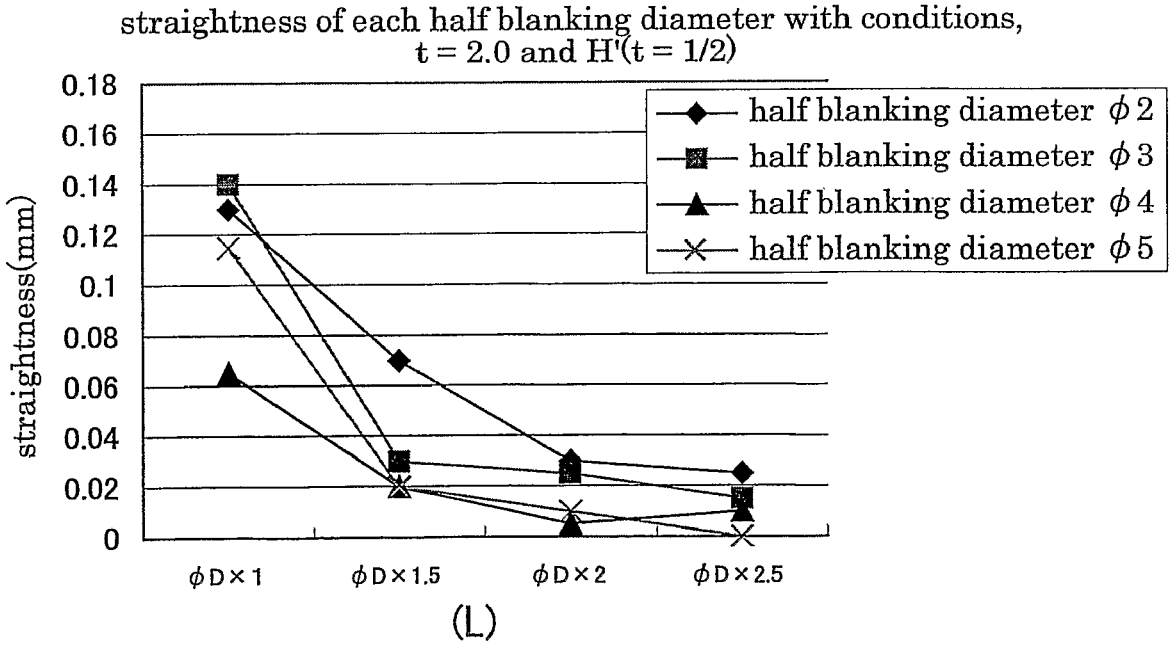
FIG. 21 is a graph of straightness obtained by changing the diameter of the fitting projection from 2 mm to 5 mm and the distance from the center of the fitting projection to the ridge line when the thickness of the nonmagnetic plate is 2.0 mm and the height of the fitting projection is ½ of the thickness.
Figure 22:
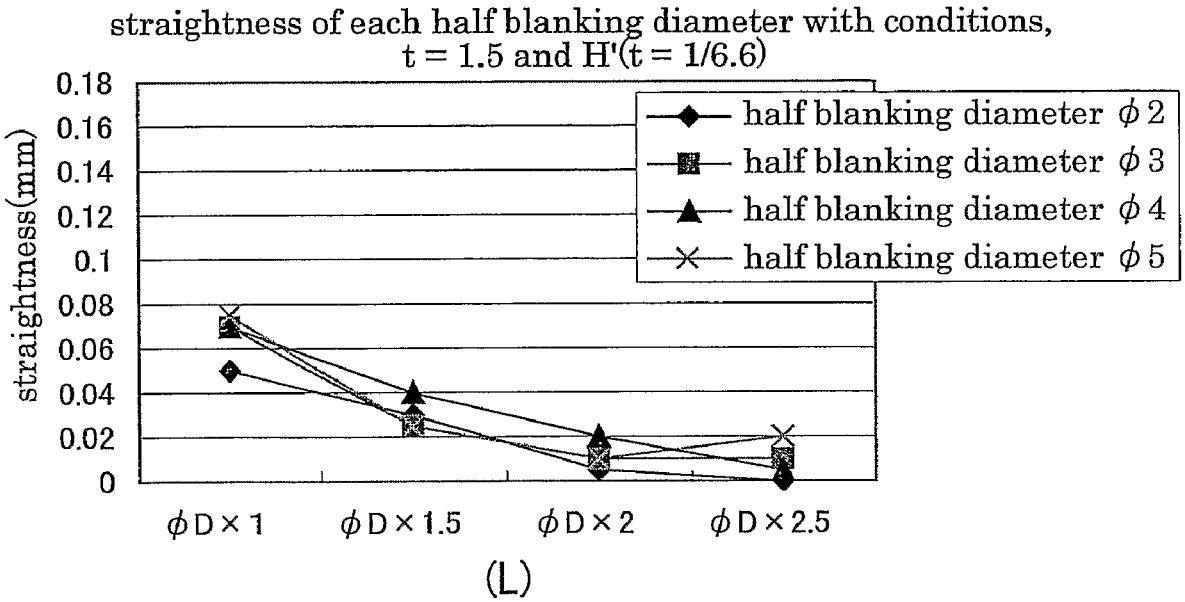
FIG. 22 is a graph of straightness obtained by changing the diameter of the fitting projection from 2 mm to 5 mm and the distance from the center of the fitting projection to the ridge line when the thickness of the nonmagnetic plate is 1.5 mm and the height of the fitting projection is 1/6.6 of the thickness.
Figure 23:
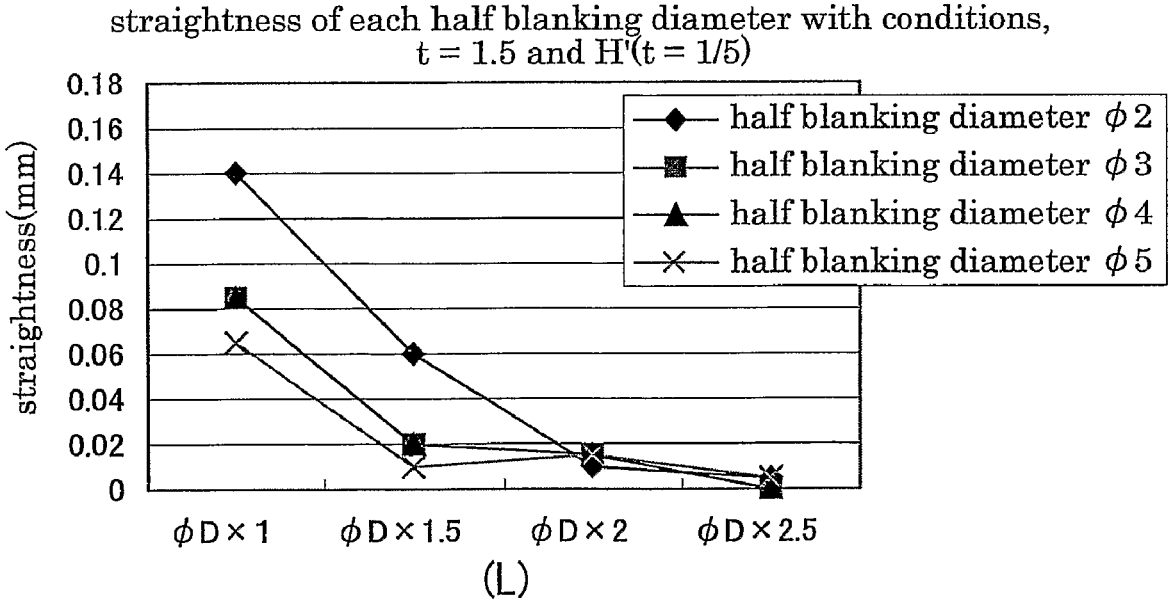
FIG. 23 is a graph of straightness obtained by changing the diameter of the fitting projection from 2 mm to 5 mm and the distance from the center of the fitting projection to the ridge line when the thickness of the nonmagnetic plate is 1.5 mm and the height of the fitting projection is ⅕ of the thickness.
Figure 24:
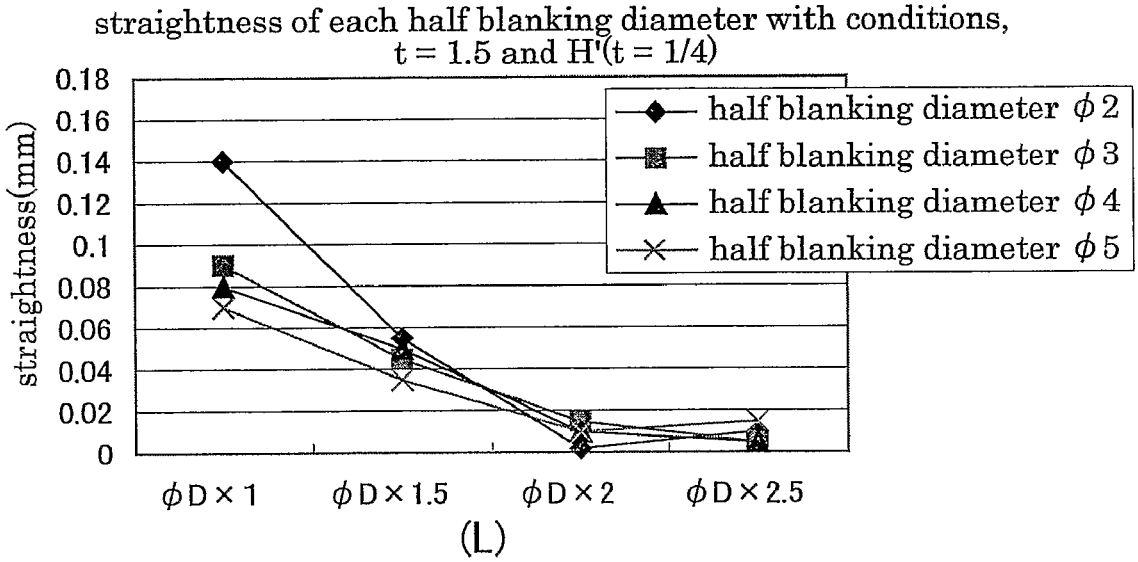
FIG. 24 is a graph of straightness obtained by changing the diameter of the fitting projection from 2 mm to 5 mm and the distance from the center of the fitting projection to the ridge line when the thickness of the nonmagnetic plate is 1.5 mm and the height of the fitting projection is 1/2.5 of the thickness.
Figure 25:
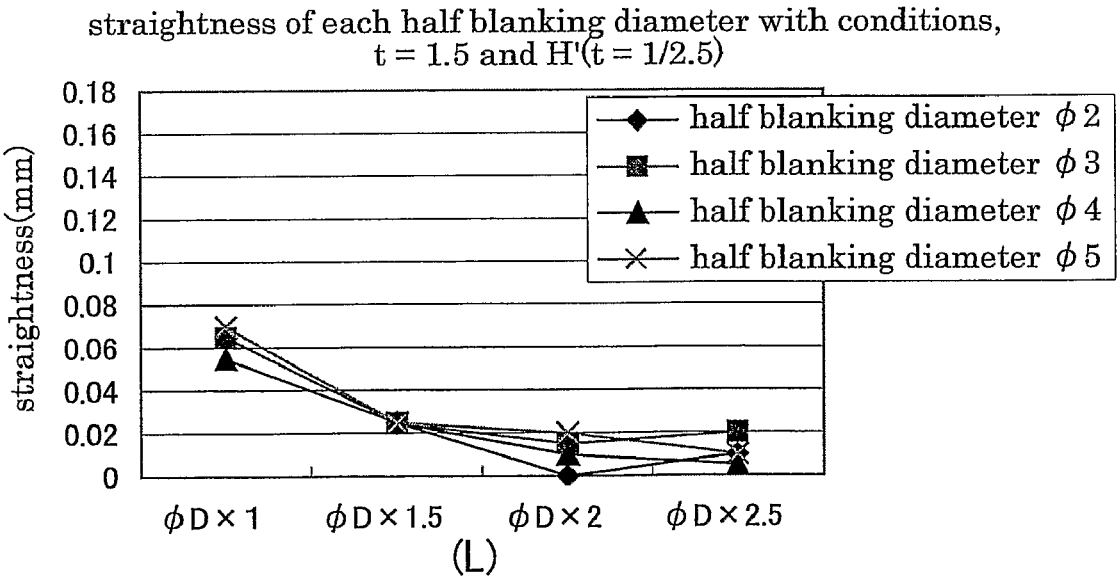
FIG. 25 is a graph of straightness obtained by changing the diameter of the fitting projection from 2 mm to 5 mm and the distance from the center of the fitting projection to the ridge line when the thickness of the nonmagnetic plate is 1.5 mm and the height of the fitting projection is 1/2.5 of the thickness.
Figure 26:
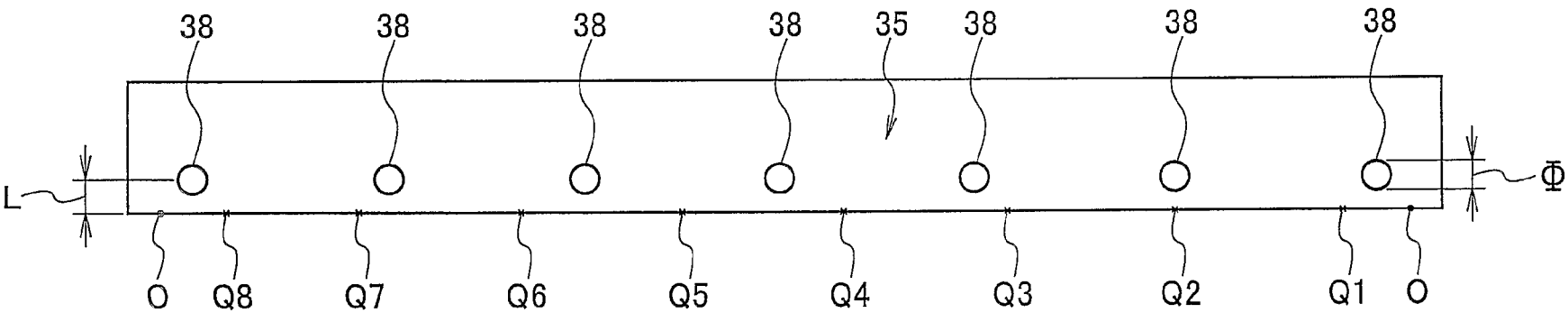
FIG. 26 is an explanation view showing one example of measuring points of the nonmagnetic plate used for obtaining the graphs of the straightness of the nonmagnetic plate shown in FIGS. 18 to 25.

On the other hand, if the direction in which the collapsed groove 52 extends is formed in the direction orthogonal to the direction in which the nonmagnetic plate 35 extends, the plastic deformation force F is mainly applied to the direction parallel to the ridge line 10 when collapsing the head portion 38*a* as illustrated in FIG. 17, so that the possibility having an influence on the straightness of the ridge line 10 is lowered.

In this case, the ridge line 10 is the edge of the sharing plane side when forming the nonmagnetic plate 35 by a sharing processing. More particular, the sharing side is the plane of the side on which the fitting projection 38 is formed. The edge of the braking plane side of the nonmagnetic plate 35 is not suitable for measuring the straightness because the edge of the breaking plane side is irregular and a large irregularity is obtained when breaking the nonmagnetic plate 35.

Figure 14:
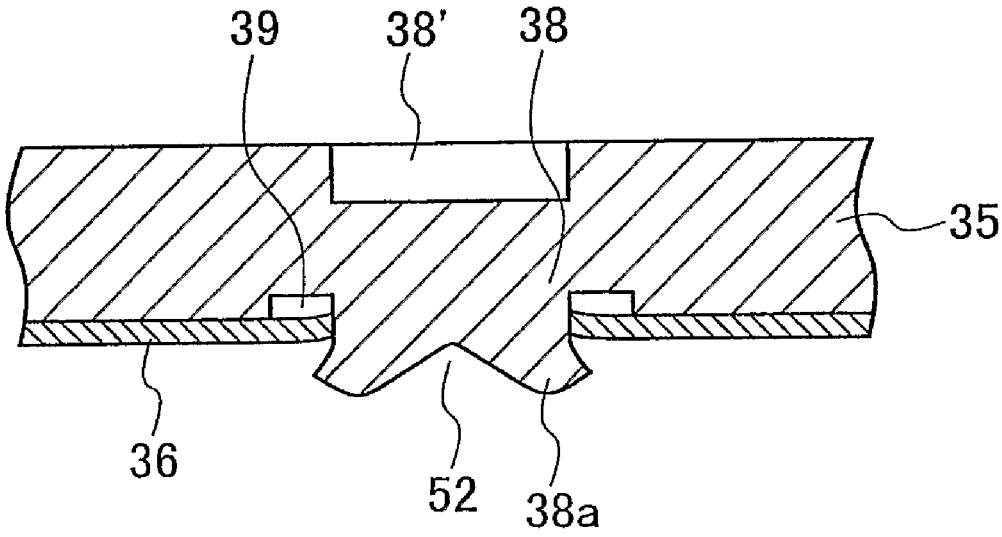
FIG. 14 is a partly enlarged cross section view showing the nonmagnetic plate and the magnetic plate fastened by the fitting projection collapsed by using the caulking punch having the V-shaped head portion illustrated in FIG. 13B.
Figure 15:
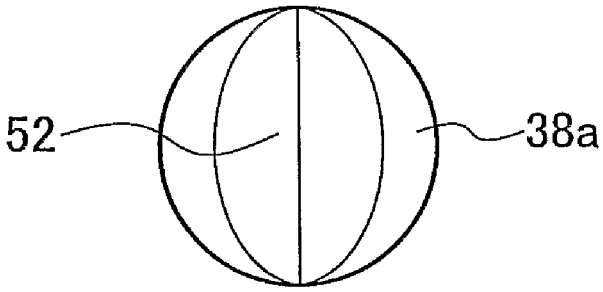
FIG. 15 is an explanation view of the collapsed groove formed on the head portion of the fitting projection illustrated in FIG. 14.

The peripheral part of the fitting hole 40 of the magnetic plate 36 is deformed in the direction that the annular grove 39 exists as shown in FIG. 14. The magnetic plate 36 is pressed to the direction that the entire plane of the magnetic plate 36 is firmly attached to the nonmagnetic plate 35. Accordingly, the developer 9 is prevented from entering into a clearance 53 between the nonmagnetic plate 35 and the magnetic plate 36, and also the developer 9 is prevented from accumulating in the clearance 53 (reference to FIG. 5) between the nonmagnetic plate 35 and the magnetic plate 36.

Hereinafter, it will be explained that results of the straightness of the ridge line 10 of the nonmagnetic plate 35 measured by changing a distance L from the ridge line 10 to the center of the fitting projection 38, a diameter Φ of the fitting projection 38, a height H' of the fitting projection and a thickness t of the nonmagnetic plate 35.

FIGS. 18 to 21 are graphs of straightness obtained by setting the thickness t of the nonmagnetic plate 35 to 2.0 mm, forming the diameter Φ of the fitting projection 38 in 2 mm, 3 mm, 4 mm and 5 mm, changing the height H' of the fitting projection 38 from ⅕, ¼, ⅓ to ½ of the thickness t, and changing the distance L from the center of the fitting projection 38 to the ridge line 10 to 1 time, 1.5 times, 2 times and 2.5 times of the diameter Φ of the fitting projection 38. The horizontal axis is the distance L from the ridge line 10 to the center, and the vertical axis is the straightness.

FIGS. 22 to 25 are the graphs of straightness obtained by setting the thickness t of the nonmagnetic plate 35 to 1.5 mm, forming the diameter Φ of the fitting projection 38 to 2 mm, 3 mm, 4 mm and 5 mm, changing the height H' of the fitting projection 38 from 1/6.6, ⅕, ¼ to 1/2.5 of the thickness t, and changing the distance L from the center of the fitting projection 38 to the ridge line 10 into 1 time, 1.5 times, 2 times and 2.5 times of the diameter Φ of the fitting projection 38. The horizontal axis is the distance L from the ridge line 10 to the center, and the vertical axis is the straightness.

In this case, the straightness is evaluated by Δ L, the amount of irregularity in the arrow directions with respect to standard points O of Q1 to Q8 by setting the standard points O at the both end portions of the nonmagnetic plate 35, and setting a plurality of measuring points from Q1 to Q8 in the longitudinal direction of the nonmagnetic plate 35 with a predetermined interval. The graphs illustrated in FIGS. 18 to 25 are the maximum vales of Δ L, the amount of the irregularity in the measuring points from Q1 to Q8.

As shown in the FIGS. 18 to 25, if the distance, L from the ridge line 10 to the center of the fitting projection 38 is set to be twice and above of the diameter Φ of the fitting projection 38, the preferable straightness of not over 0.05 mm can be obtained. In addition, according to the present embodiment, if the distance L from the ridge line 10 to the center of the fitting projection 38 is set to be twice and above of the diameter Φ of the fitting projection 38, the squareness of the ridge line 10 can be ensured, so that the width W in the direction orthogonal to the longitudinal direction of the magnetic plate 36 can be lowered. Accordingly, the magnetic material can be saved, and also the strength of the magnetic force can be controlled.

Comparing FIGS. 18 to 21 with FIGS. 22 to 25, the favorable results of the straightness are obtained when the thickness t of the nonmagnetic plate 35 is thinner. It is considered that the nonmagnetic plate 35 can be easily folded into L-shape when the nonmagnetic plate 35 is thin, and the deformation to be applied to the nonmagnetic plate 35 is small.

When the nonmagnetic plate 36 is mounted onto the magnetic plate 35 by caulking, the straightness of not over 0.05 mm could also be obtained.

Moreover, the image evaluation and the endurance test were performed by mounting the developer-controlling member 31 formed by fastening the magnetic plate 36 to the nonmagnetic plate 35 having the fitting projection 38 with the 30 mm interval by the caulking process to the image forming apparatus capable of printing 60 sheets of A4 paper per minute.

As a result, an imaging defect resulting from the developer-controlling member 31 was not generated. Moreover, the endurance test corresponding to 600000 sheets was carried out; however, the separation and deformation of the magnetic plate were not found. Accordingly, the fastening between the nonmagnetic plate 35 and the magnetic plate 36 by the caulking is confirmed as fastening means having high reliability.

In addition, a plurality of half blanking fitting projections 38 can be formed at one time onto the nonmagnetic plate 35 by using the die 43. The plurality of fitting projections 38 can be caulked at one time by using the caulking die 48. The caulking process time between the nonmagnetic plate 35 and the magnetic plate 36 is about 5 seconds per one piece about the developer-controlling member 31, so that the process time can be reduced, and also a press working can be adopted for the entire manufacturing processes of the developer-controlling member 31. In addition, there are advantages of contributing to the stock control and logistic control.

The embodiment of the present invention was explained as above; however, the present invention is not limited to the above, and includes the following.

(1) In the embodiment of the present invention, the half blanking fitting projection 38 is formed on the nonmagnetic plate 35, and the fitting hole 40 fitting to the fitting projection 38 is formed on the magnetic plate 36. However, the half blanking fitting projection can be formed on the magnetic plate 36, and the fitting hole fitting to the fitting projection can be formed on the nonmagnetic plate 35.

(2) In the embodiment of the present invention, the half blanking fitting projection 38 is formed on the nonmagnetic plate 35, the fitting hole 40 fitting to the fitting projection 38 is formed on the magnetic plate 36, and the fitting projection 38 is caulked. However, the fitting projection 38 can be lightly pressed into the fitting hole 40 to mount the magnetic plate 36 on the nonmagnetic plate 35.

(3) A positioning pin (not shown) of the magnetic plate 36 can be provided in the nonmagnetic plate 35.

Figure 27:
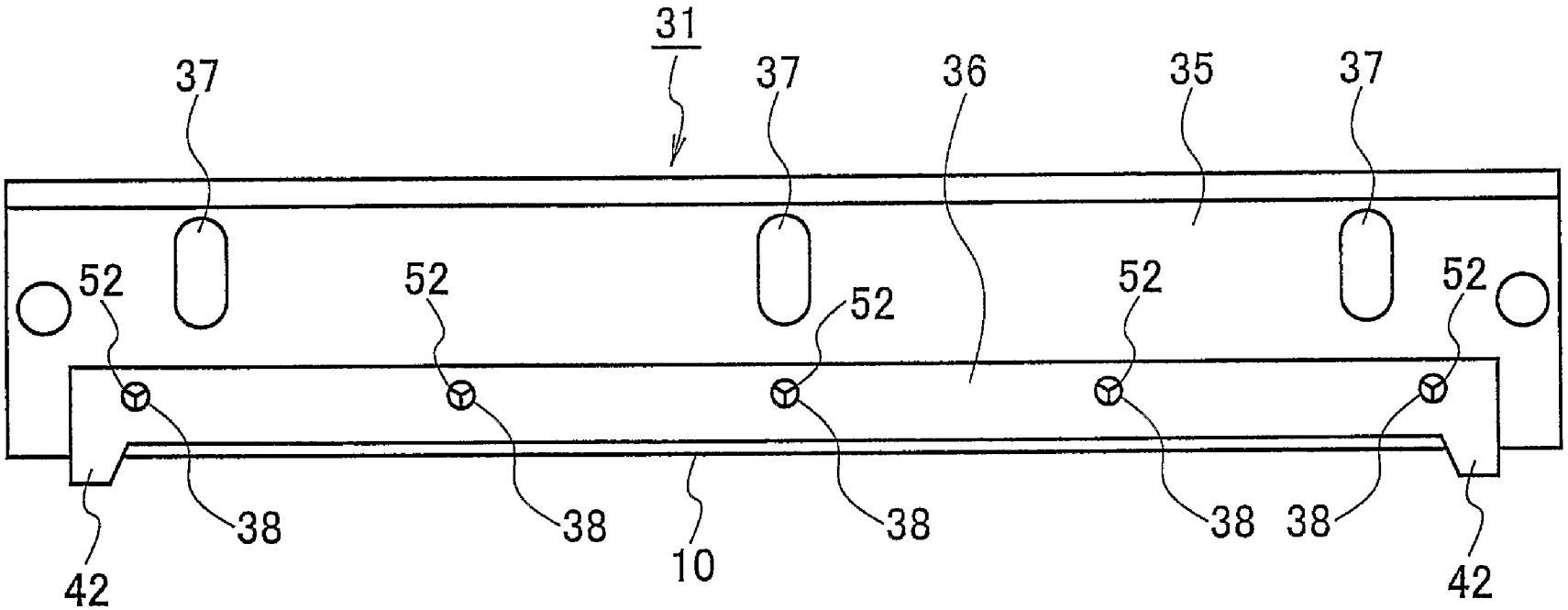
FIG. 27 is an explanation view illustrating another shape of a collapsed groove formed on a head portion of a matching projection.

(4) When the inner clip washer punch 51 illustrated in FIG. 13C is used, it is preferable for the collapsed groove 52 to be the Y-shape as shown in FIG. 27.

Figure 28A:
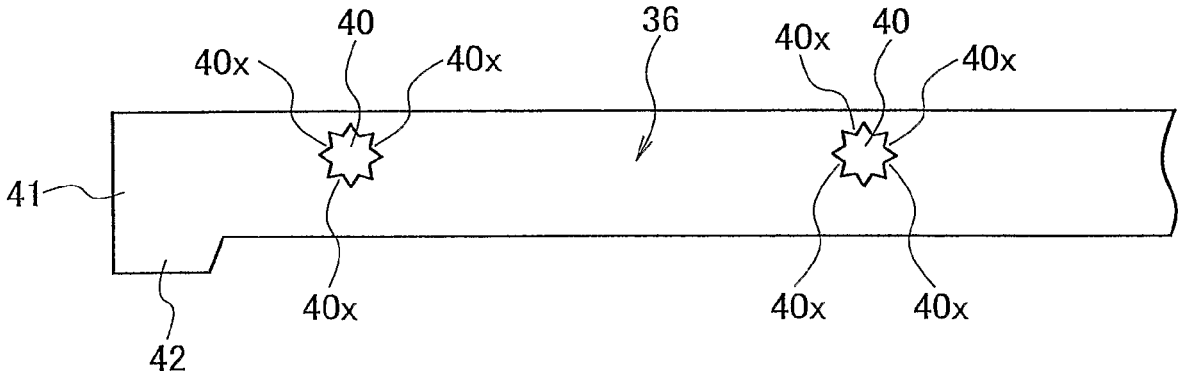
FIG. 28A is a partly enlarged view showing one example that a sharp angle-shaped section is formed in a peripheral wall of a hole portion of a nonmagnetic plate.
Figure 28B:
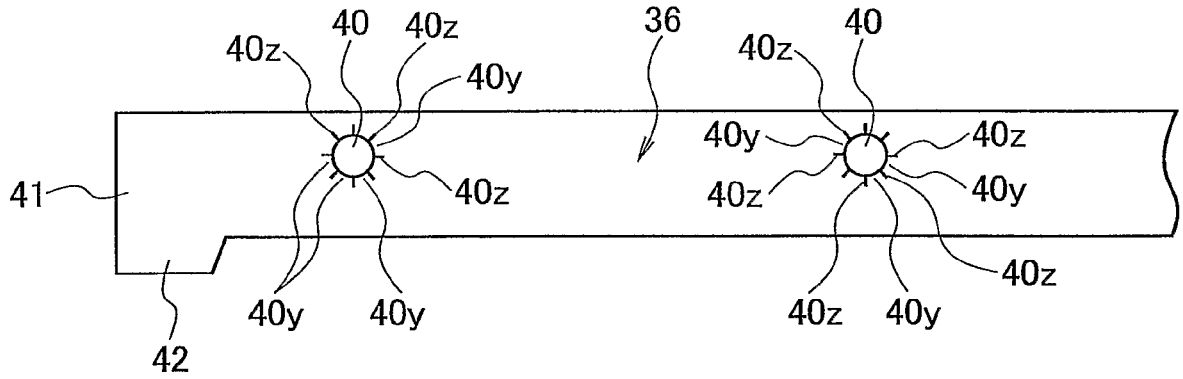
FIG. 28B is a partly enlarged view showing one example that a radially cut section is formed in a peripheral wall of a hole portion of a nonmagnetic plate.

(5) As illustrated in FIG. 28A, if a sharp angle-shaped piece 40*x* is formed in the peripheral wall of the hole portion 40 of the magnetic plate 36, or a radially cut piece 40*y* is formed by forming a radially cut silt 40*z* in the peripheral wall of the hole portion 40 of the nonmagnetic plate 36 as illustrated in FIG. 28B, the sharp angle-shaped piece and the radially cut piece 40*y* is easily deformed toward the annular groove 39 when caulking the fitting projection 38. Accordingly, the stress deformation by the caulking can be reduced for the entire magnetic plate 36.

Figure 29A:
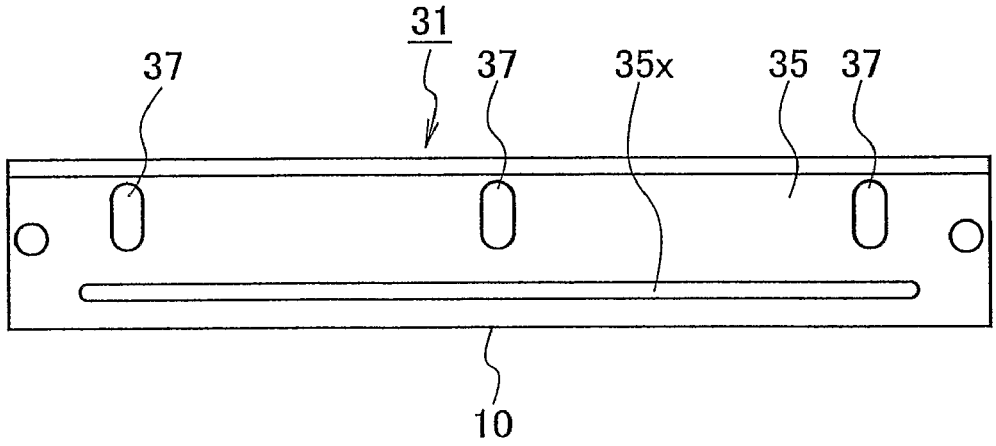
FIG. 29A is a plan view illustrating a magnetic plate in which a swelling projection extending in the longitudinal direction of the nonmagnetic plate is formed on the nonmagnetic plate.
Figure 29B:
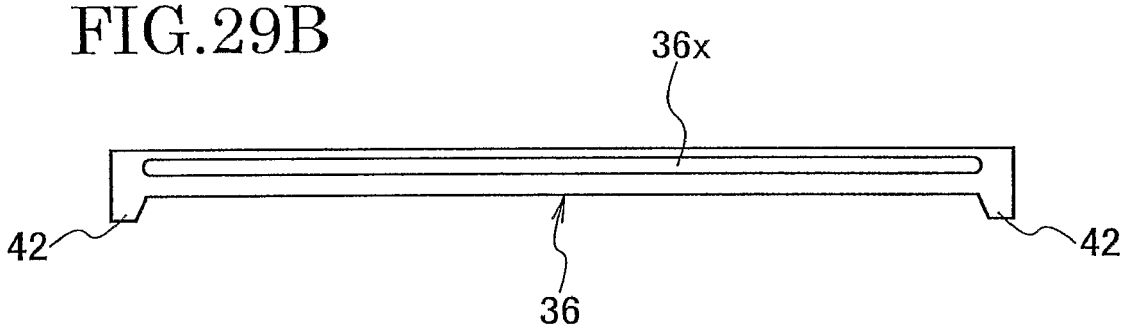
FIG. 29B is a plan view illustrating the magnetic plate in which an elongate hole fitting to the swelling projection shown in FIG. 29A is formed on the magnetic plate.
Figure 29C:
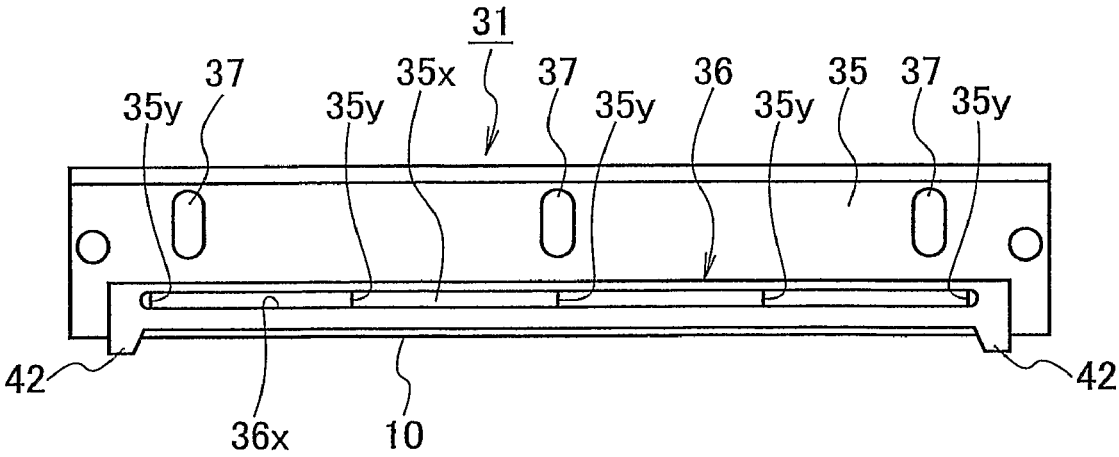
FIG. 29C is a view illustrating a fastened state between the nonmagnetic plate shown in FIG. 29A and the magnetic plate shown in FIG. 29B.

(6) As illustrated in FIG. 29A, a half blanking swelling portion 35*x* extending in the longitudinal direction of the nonmagnetic plate 35 can be formed on the nonmagnetic plate 35, and an elongate hole 36*x* fitting to the swelling portion 35*x* can be formed on the magnetic plate 36 as illustrated in FIG. 29B. The swelling portion 35*x* can be fitted into the elongate hole 36*x*, and caulking portions 35*y* can be formed on the swelling portion 35*x* spacing in the longitudinal direction of the swelling portion 35*x* as shown in FIG. 29C. Accordingly, the magnetic plate 36 can be mounted on the nonmagnetic plate 35.

According to the above structure, the position in the longitudinal direction, the interval and the quantity of the caulking portion 35*y* can be flexibly chosen.

Figure 30A:
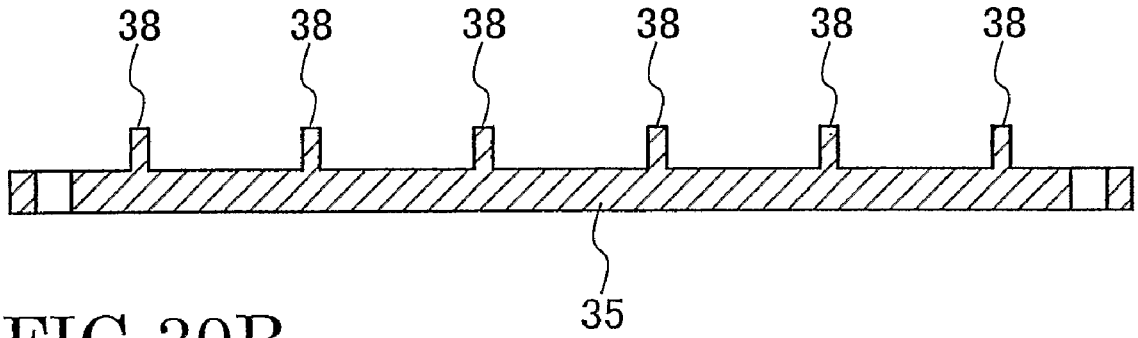
FIG. 30A is a cross section view showing a nonmagnetic plate comprising a plastic material.
Figure 30B:
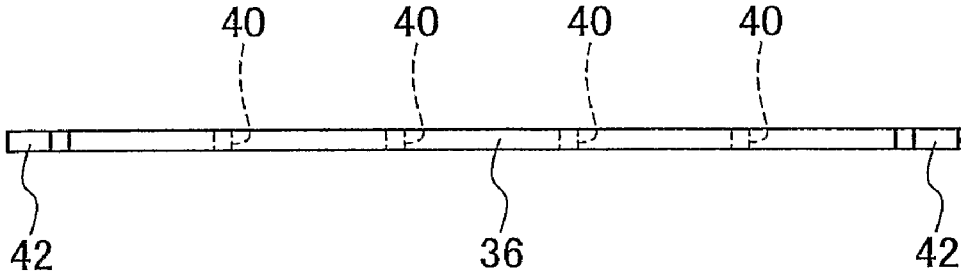
FIG. 30B is a side view showing a magnetic plate to be fastened to the nonmagnetic plate.
Figure 30C:
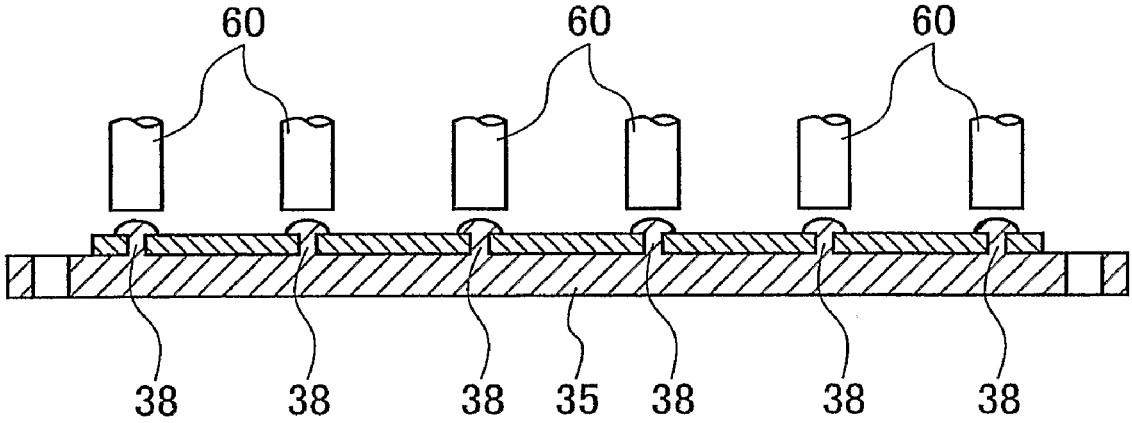
FIG. 30C is a cross section view showing a fastened state between the nonmagnetic plate and the magnetic plate.

(7) A plastic material can be used as a nonmagnetic plate 35, and the fitting projection 38 can be formed on the nonmagnetic plate 35 as illustrated in FIG. 30A. The magnetic plate 36 shown in FIG. 30B can be fitted to the fitting projection 38, and the magnetic plate 36 can be mounted onto the nonmagnetic plate 35 by melting the head portion of the fitting projection 38 by using a supersonic horn 60 illustrated in FIG. 30C.

In this case, if the a radially cut slit is formed in the periphery wall of the hole portion 40, the melted portion of the fitting portion 38 is entered into the radially cut slit. The bond strength between the nonmagnetic plate 35 and the magnetic plate 36 can be, accordingly, improved.

According to the above structure, the developer-controlling member can be manufactured without using a metal plate as the nonmagnetic plate.

As described above, the fitting projection 38 is formed on the nonmagnetic plate 35 as a first long plate or a second long plate having a thickness different from the first long plate. The fitting hole 40 fitting to the fitting projection 38 is formed on the magnetic plate 36 as the second long plate having a thickness different from the first long plate or the first long plate. The fitting projection 38 and the fitting hole 40 are fitted to form a developer-controlling member as a jointed plate by caulking the fitting projection 38.

In addition, the jointed plate is not limited to be used for the developer-controlling member. The jointed plate can be used for a member having a function similar to the developer-controlling member, for example, a scraper. In this case, the first long plate and the second plate may comprise a nonmagnetic metal plate, respectively.

Those skilled in the art will recognize that many modifications to the embodiment described above are possible within the scope of the invention, which is defined in the appended claims.

The invention claimed is:

1. A developer-controlling member comprising:

a first plate and a second plate which extend in a longitudinal direction of a developing roller including a magnet roller, wherein a plurality of half blanking fitting projections is formed on of the first and second plates spacing in a longitudinal direction of the one of the first and second plates, fitting holes fitting to the fitting projections are formed on the other of the first and second plates corresponding to the fitting projections, the first plate and the second plate are fastened by caulking respective fitting projections, and a diameter of the fitting hole is slightly larger than a diameter of the fitting projection.

2. The developer-controlling member according to claim 1, wherein a head portion of the fitting projection is collapsed by a V-shape punch to be divided into two.

3. The developer-controlling member according to claim 1, wherein a direction of a collapsed groove formed on a head portion of the fitting projection is a direction orthogonal to the longitudinal direction of the second plate.

4. The developer-controlling member according to claim 1, wherein the fitting projection has a circular shape, and an annular groove for absorbing a deformation of the first plate when collapsing a head portion of the fitting projection surrounds an outer circumference of an elementary part of the fitting projection.

5. The developer-controlling member according to claim 1, wherein a distance from a center portion of the fitting projection to a ridge line facing the developing roller of the second plate is twice and above of a diameter of the fitting projection.

6. A developing machine comprising the developer-controlling member according to claim 1.

7. An image forming apparatus comprising the developing machine according to claim 6.

8. A printer comprising the developing machine according to claim 6.

9. The developer-controlling member according to claim 1, wherein the first plate is a magnetic plate and the second plate is a nonmagnetic plate.

10. The developer-controlling member according to claim 9, wherein the plurality of half blanking fitting projections is formed on the nonmagnetic plate, and the fitting holes fitting to the fitting projections are formed on the magnetic plate.

11. The developer-controlling member according to claim 9, wherein a direction of a collapsed groove formed on a head portion of the fitting projection is a direction orthogonal to the longitudinal direction of the nonmagnetic plate.

12. The developer-controlling member according to claim 9, wherein the fitting projection has a circular shape, and an annular groove for absorbing a deformation of the magnetic plate when collapsing a head portion of the fitting projection surrounds an outer circumference of an elementary part of the fitting projection.

13. The developer-controlling member according to claim 9, wherein a distance from a center portion of the fitting projection to a ridge line facing the developing roller of the nonmagnetic plate is twice and above of a diameter of the fitting projection.

14. A method for manufacturing a developer-controlling member, comprising:

a half blanking step of forming a plurality of half blanking fitting projections on a nonmagnetic plate extending in a longitudinal direction of a developing roller including a magnet roller, spacing in a longitudinal direction of the nonmagnetic plate, and forming an annular groove surrounding an outer circumference of an elementary part of the fitting projection;

a setting step of setting a magnetic plate on the nonmagnetic plate by fitting respective fitting holes of the magnetic plate including the fitting holes formed by corresponding to the fitting projections to the fitting projections; and a step of collapsing the fitting projection by applying a pressurizing force to a head portion of the fitting projection by a forming punch having a V-shape head portion with a state that the magnetic plate is set on the nonmagnetic plate.

15. A jointed plate, comprising:

a first long plate including a nonmagnetic metal; and a second long plate including a metal plate having a thickness different from a thickness of the first long plate, wherein a half blanking fitting projection is formed on the first long plate, a fitting hole fitting to the fitting projection is formed on the second long plate, the fitting projection and fitting hole are fitted such that the first long plate and the second long plate are fastened by caulking the fitting projection, and a sharp angle-shaped piece is formed in a peripheral wall of the fitting hole of the second long plate or a radially cut piece is formed in the peripheral wall of the fitting hole of the second long plate.

16. The jointed plate according to claim 15, wherein a half blanking fitting hole is formed on the long plate having a thickness thicker than the other long plate.

* * * * *